US007456588B2

(12) United States Patent
Alexandrov

(10) Patent No.: US 7,456,588 B2
(45) Date of Patent: Nov. 25, 2008

(54) ARRANGEMENT AND METHOD FOR PROVIDING POWER LINE COMMUNICATION FROM AN AC POWER SOURCE TO A CIRCUIT FOR POWERING A LOAD, AND ELECTRONIC BALLASTS THEREFOR

(75) Inventor: Felix I. Alexandrov, Bedford, MA (US)

(73) Assignee: Osram Sylvania Inc., Danvers, MA (US)

( * ) Notice: Subject to any disclaimer, the term of this patent is extended or adjusted under 35 U.S.C. 154(b) by 163 days.

(21) Appl. No.: 11/446,834

(22) Filed: Jun. 5, 2006

(65) Prior Publication Data

US 2006/0202640 A1 Sep. 14, 2006

(51) Int. Cl.
*G05F 1/00* (2006.01)

(52) U.S. Cl. ..... 315/294; 315/288; 315/313; 340/310.11; 340/310.13; 700/297

(58) Field of Classification Search ..... 315/209 R, 315/247, 288, 294, 295, 297, 307, 308, 312, 315/313, 320, DIG. 4, DIG. 7; 340/310.11–310.14, 340/309.16; 700/20, 22, 286, 295, 297, 298
See application file for complete search history.

(56) References Cited

U.S. PATENT DOCUMENTS

| | | | | |
|---|---|---|---|---|
| 4,016,429 A | | 4/1977 | Vercellotti et al. | 307/149 |
| 4,408,186 A | | 10/1983 | Howell | 340/310 |
| 4,433,326 A | | 2/1984 | Howell | 340/310 |
| 4,538,136 A | | 8/1985 | Drabing | 340/310 |
| 5,066,939 A | * | 11/1991 | Mansfield, Jr. | 455/402 |
| 5,475,360 A | | 12/1995 | Guidette et al. | 340/310.01 |
| 5,689,230 A | | 11/1997 | Merwin et al. | 340/310.01 |
| 6,377,163 B1 | | 4/2002 | Deller et al. | 340/310.01 |
| 6,842,668 B2 | | 1/2005 | Carson et al. | 700/286 |
| 7,007,305 B2 | * | 2/2006 | Carson et al. | 726/36 |
| 7,009,348 B2 | * | 3/2006 | Mogilner et al. | 315/307 |
| 7,154,229 B2 | * | 12/2006 | Alexandrov et al. | 315/209 R |
| 2003/0189495 A1 | | 10/2003 | Pettler et al. | 340/854.3 |
| 2006/0091818 A1 | | 5/2006 | Alexandrov et al. | 315/209 |

* cited by examiner

*Primary Examiner*—Haissa Philogene
(74) *Attorney, Agent, or Firm*—Carlo S. Bessone

(57) ABSTRACT

An arrangement (900) and method (1000) for providing power line communication from an AC power source (910) to a circuit (900) for supplying power to a load (960), as well as electronic ballasts (20,30,40,70,80) that operate according to the method (1000). Method (1000) includes the steps of: providing (1010) an AC power source (910) that includes hot, neutral, and ground wires (10,12,14) and a control station (914) for generating a power line carrier control signal; providing (1020) a power supply circuit (920) having an EMI filter (930), power processing circuitry (940), and a power line communication (PLC) circuit (950); setting (1030) a fundamental frequency of the power line carrier control signal to be about equal to either an effective common-mode resonant frequency of the EMI filter (930) or a harmonic thereof; injecting (1040) a power line carrier control signal between the neutral and ground wires (12,14) of the AC power source (910); detecting (1050) the power line carrier control signal by monitoring a current flowing from the ground wire (14) to a circuit ground (90); and directing (1060) the power processing circuitry (940) to control load power in dependence on the detected power line carrier control signal. Specific preferred embodiments are directed to electronic ballasts (20,30,40,70,80) that include various PLC circuits (300,400,500,700).

27 Claims, 11 Drawing Sheets

ARRANGEMENT AND METHOD FOR PROVIDING POWER LINE COMMUNICATION FROM AN AC POWER SOURCE TO A CIRCUIT FOR POWERING A LOAD, AND ELECTRONIC BALLASTS THEREFOR

FIELD OF THE INVENTION

The present invention relates to the general subject of power line communication. More particularly, the present invention relates to a power line communication arrangement and method that is well suited for use with power supplies and electronic ballasts that are, preferably, installed in buildings.

BACKGROUND OF THE INVENTION

Various power line communication (PLC) approaches are known in the art. Existing approaches for PLC control are basically carrier frequency based methods that utilize at least one high frequency carrier. For example:

U.S. Pat. No. 4,538,136 (issued to Drabbing) teaches a two frequency keyed signal PLC system having a first predetermined frequency representing a first state of information (e.g., a "0") and a second predetermined frequency representing a second state of information (e.g. a "1").

U.S. Pat. No. 6,377,163 (issued to Deller et al) teaches a PLC arrangement having a high frequency communication component that is superimposed on an AC line voltage. A carrier signal that it is transmitted during a time interval coinciding with a positive half cycle of the AC line voltage represents the first state of information, while a carrier signal that is transmitted during a time interval coincident with a negative half cycle of the AC line voltage represents the second state of information. Binary data generated at the PLC transmitter is synchronized with the AC line voltage, assuming a negligible phase shift between the AC line voltages at the transmitter and the receiver.

In the aforementioned patents, the hot and neutral wires of the AC power source are used for transmitting a carrier signal from the transmitter to the receiver.

U.S. Pat. No. 4,016,429 (issued to Vercellotti et al) and U.S. Pat. Nos. 4,408,186 and 4,433,326 (both of which were issued to Howel) teach carrier PLC that is transmitted via the ground and neutral wires of the AC power source. This approach is most suitable for loads in a building that is wired to accommodate grounding connections the loads, which is generally present in building that include electronic ballasts. An advantage of this approach, in comparison with approaches that utilize the hot and neutral wires to transmit a carrier signal, is that the carrier frequency source (transmitter) is not as affected by the 60 Hz high voltage that is provided between the hot and neutral wires.

U.S. Pat. No. 6,842,668 (issued to Carson) disclosed a remotely accessible power controller for building lighting. A major disadvantage of this type of controller is that it requires an isolated interface having an isolated auxiliary power supply (operating directly from the hot and neutral wires of the AC power source), as well as additional band pass filters.

U.S. Pat. No. 5,475,360 (issued to Guidette et al) and U.S. Patent Application 2003/0189495 (filed by Pettler et al) disclose a PLC approach for lighting systems that includes carrier signal receivers (responders) as separate control devices that interface/communicate with one or more ballasts having dimming capabilities.

FIG. 1 describes a common prior art arrangement for providing power line communication (PLC) from an AC power source (not shown in detail) to one or more dimming ballasts for powering gas discharge lamps. As described in FIG. 1, the arrangement includes a responder (i.e., a PLC receiver) that is separate from the dimming ballast(s). During operation, the AC power source generates a carrier control signal, $V_{CONTROL}$, having an average value of $+V_{IN}$, as described in FIG. 2. In order to provide binary coding capability, the generation of $V_{CONTROL}$ may be keyed (i.e., timed) to coincide with the positive and negative half cycles of the line voltage, $V_{LINE}$, provided between the hot and neutral wires of the AC power source. As illustrated in FIG. 3, the carrier control signal is superimposed upon $V_{LINE}$. Referring back to FIG. 1, the carrier control signal in $V_{LINE}$ is detected and processed by the responder, which then sends an appropriate signal directing the dimming ballast(s) to control the power provided to the lamp(s).

The main drawback of the aforementioned approaches is that the carrier signal receivers and processors are not integrated within the controlled device (e.g., ballasts). For example, in a PLC system for controlling a lamp dimming ballast, the signal receiver is generally referenced to the neutral wire, while the circuitry within the ballast is generally referenced to the negative terminal of bridge rectifier within the ballast. Consequently, additional means are required for providing for signal decoupling, amplifying, and filtering. Accordingly, a relatively expensive and physically large auxiliary AC/DC power supply (that is referenced to the neutral wire of the AC power source) must be provided for the ballast, which makes it very difficult (if not impossible) to mechanical integrate the PLC receiver within the housing of a standard ballast. Consequently, existing PLC systems for lighting applications are generally plagued by high cost and complexity, as well as substantial physical space requirements.

Toward the goal of reducing the size and cost of the PLC receiver, PLC approaches often employ carrier frequencies in excess of 100 kilohertz. Unfortunately, high carrier frequencies are often problematic due to the significant signal attenuation that is caused by the distributed inductances and capacitances that is typically present in the AC wiring of a building. In particular, the distributed inductances and capacitances in the AC wiring places limits upon the maximum permissible physical distance between the control station and the receiver. High frequency carrier approaches have the additional constraint that they must not interfere with operation of AM/FM radios or other PLC systems within the building. These limitations are especially problematic in industrial buildings, where the presence of potentially high levels of noise on the AC power line (i.e., in the voltage between the hot and neutral wires of the AC power source) can seriously compromise the ability to detect and recover high frequency carrier control signals.

Yet another challenge to successfully placing a PLC receiver within a power supply or electronic ballasts is the requirement that the PLC receiver must be compatible with the other circuitry within the power supply or ballast. More particularly, power supplies and electronic ballasts often include active power factor correction (PFC) and inverter circuitry that operates at high frequencies (i.e., in excess of 20 kilohertz) and that, consequently, generates a wide spectrum of noise. A PLC receiver that is mechanically and electrically integrated within a power supply or electronic ballast must be capable of reliably operating is such noisy environments.

Power line communication approaches that utilize a Digital Addressable Lighting Interface (DALI) communication line have become more commonplace in recent years. DALI systems (which are defined in the EN 60929 standard) are intended to provide two-way communication between a power supply/ballast and a control station at the AC power source. A major drawback of DALI approaches is that power supplies and ballasts that utilize DALI require individual supply cables consisting of three power wires (hot, neutral, and ground), as well as two dedicated low voltage signal wires that must be electrically isolated from the main circuitry within the power supply or ballast. The extensive wiring that is required for DALI systems is a major cost impediment to implementing those systems, especially in retrofit applications.

Therefore, a need still exists for reliable PLC methods and circuits that can be readily implemented within existing power supplies and electronic ballasts in a cost-effective and space-efficient manner. Such methods and circuits would represent a significant advance over the prior art.

DETAILED DESCRIPTION OF THE PREFERRED EMBODIMENTS

The present invention relates to power line communication (PLC) methods and circuits for use with power supplies and electronic ballasts. In particular, the present invention relates to PLC methods and circuits that provide one-way communication from an AC power source to a power supply or electronic ballast (i.e., without providing feedback messages from the power supply or ballast to a control station within the AC power source). The present invention is generally applicable to AC line powered power supplies or electronic ballasts for commercial, industrial, and/or residential wiring that utilizes neutral and ground connections, and in which the power supplies or ballasts include an electromagnetic interference (EMI) filter and, preferably, a power factor correction circuit.

Specific preferred embodiments of the present invention related to arrangements that include controllable (dimmable) electronic ballasts for powering gas discharge lamps. Specific applications of the present invention provide a communication system between an AC power source and electronic ballasts in which the AC source includes a control station for transmitting commands along the AC power wires, and in which the ballasts include circuitry for detecting the commands and controlling the amount of power provided to the lamps in accordance with the commands. Such ballasts may be used in remotely controlled lighting systems in offices or industrial buildings, or in outdoor environment, without any need for additional dedicated control wiring to the ballasts.

The present invention provides a cost-effective alternative to approaches that utilize a Digital Addressable Lighting Interface (DALI) communication line. Power supplies and electronic ballasts according to present invention do not require individual supply cables or dedicated low voltage signal wires. Thus, the present invention provides a significant advantage (especially with regard to installation cost/complexity) over DALI systems, especially for those applications in which two-way communication is not needed and for retrofitting lighting systems in a building.

The PLC methods and circuits of the present invention may be used for individual or group control of electronic ballasts. For example, one of the more basic applications of the present invention is to provide load shed functionality for a lighting system that includes one or more electronic dimming ballasts. In that particular application, the PLC method need only be capable of transmitting a single bit of information (i.e., either an "on/off" or a "dim" command) from the AC power source to the ballast(s).

The preferred embodiments of the present invention are now described in detail with reference to FIGS. 4-12.

Figure 4:
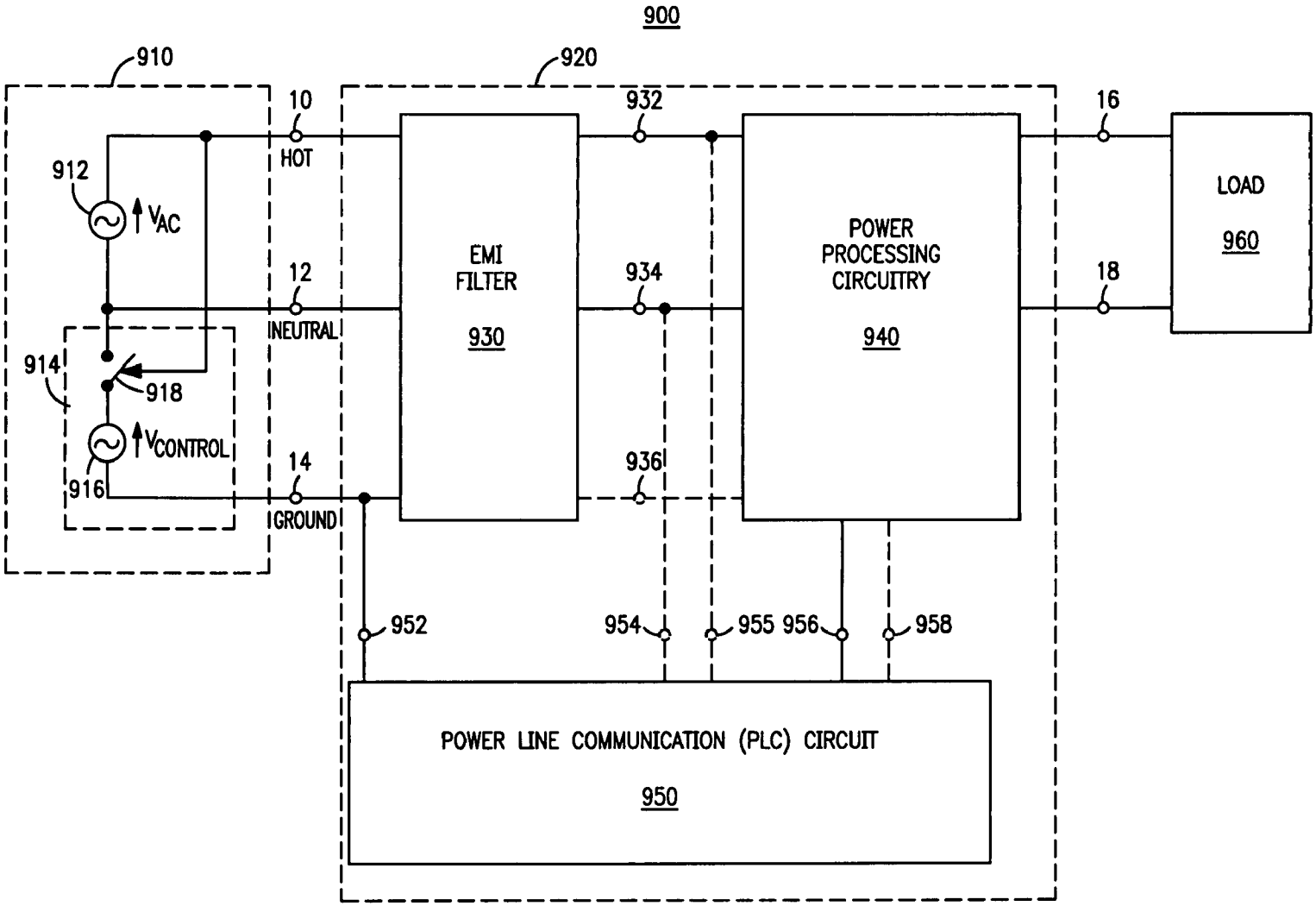
FIG. 4 is a block-diagram schematic of an arrangement for providing power line communication from an AC power source to a circuit for supplying power to a load, in accordance with the preferred embodiments of the present invention.

FIG. 4 describes an arrangement for providing power line communication (PLC) from an alternating current (AC) power source to a circuit for supplying power to a load. Arrangement 900 includes an AC power source 910, a power supply circuit 920, and a load 960.

AC power source 910 includes a hot wire 10, a neutral wire 12, a ground wire 14, a conventional AC voltage source 912, and a control station 914. Conventional AC voltage source 912 provides a typical AC power line voltage (e.g., 120 volts rms at a frequency of 60 hertz), $V_{AC}$, between hot wire 10 and neutral wire 12. Control station 914, which is coupled between neutral wire 12 and ground wire 14, includes a series arrangement of a power line carrier control signal generator 916 and a switch means 918 (depicted as an electrical switch in FIG. 4). During operation, power line carrier control signal generator 916 provides a periodic control voltage, $V_{CONTROL}$, having a predetermined fundamental frequency, $f_{CONTROL}$.

Preferably, $V_{CONTROL}$ has a substantially sinusoidal waveshape; however, $V_{CONTROL}$ may also be realized with a substantially nonsinusoidal waveshape (e.g., a squarewave). Although switch means 918 is depicted in FIG. 4 as an electrical switch, it should be understood that switch means 918 may be realized by any of a number of suitable arrangements (e.g., controllable electronic switches, such as power transistors, along with associated peripheral circuitry) that are known to those skilled in the art. During operation, control station 914 injects a power line carrier control signal between neutral wire 12 and ground wire 14. The purpose of the power line carrier control signal is to convey information (e.g., a command for controlling the amount of power supplied to load 960) from AC power source 910 to power supply circuit 920. For practical reasons, it is preferred that the power line carrier control signal be injected in dependence on the phase of $V_{AC}$ by suitable operation of switch means 918; accordingly, in FIG. 4, switch means 918 is shown as being operably coupled to hot wire 10.

As described in FIG. 4, power supply circuit 920 comprises an electromagnetic interference (EMI) filter 930, power processing circuitry 940, and a power line communication (PLC) circuit 950.

EMI filter 930 is coupled to hot, neutral, and ground wires 10,12,14 of AC power source 910. EMI filter 930 has an effective common-mode resonant frequency, $f_{RES}$. The periodic control voltage, $V_{CONTROL}$, provided by power line carrier control signal generator 916 is selected to have a fundamental frequency that is approximately equal to either the effective common-mode resonant frequency, $f_{RES}$, of EMI filter 930, or a harmonic of $f_{RES}$. Preferred structures for realizing EMI filter 930 are described in further detail herein (i.e., with reference to FIGS. 7, 9, 11, and 12).

Power processing circuitry 940 is coupled between EMI filter 930 (via output connections 932,934,936 of EMI filter 930) and load 960 (via output connections 16,18 of power supply 920). The function of power processing circuitry 940 is to provide a conditioned and controlled source of power for load 960. In certain applications, such as in electronic ballasts for gas discharge lamps, it is common for power processing circuitry 940 to include a combination of a power factor correcting AC-to-DC converter (e.g., a full-wave bridge rectifier followed by a boost converter) and a high frequency DC-to-AC converter (e.g., an inverter followed by a resonant output circuit).

Power line communication (PLC) circuit 950 is coupled to EMI filter 930 (via input connection 952) and power processing circuitry 940 (via at least one output connection 956). Optionally, PLC circuit 950 may also be coupled to output terminals 932,934 of EMI filter 930 (via optional input connections 955,954, respectively). During operation, PLC circuit 950 detects if a power line carrier control signal is present; if so, PLC circuit 950 directs power processing circuitry 940 to control the power, $P_{LOAD}$, provided to load 960 in dependence on the detected power line carrier control signal.

Optionally, PLC circuit 950 may be configured to be capable of directing power processing circuitry 940 to control $P_{LOAD}$ in dependence not only on the detected power line carrier control signal, but also in dependence on the timing of the power line carrier control signal with respect to the phase of $V_{AC}$. More specifically, if the power line carrier control signal occurs during a positive half cycle of $V_{AC}$, then PLC circuit 950 directs power processing circuitry 940 to control the power to load 960 in a first manner; conversely, if the power line carrier control signal occurs during a negative half cycle of $V_{AC}$, then PLC circuit 950 directs power processing circuitry 940 to control the power to load 960 in a second manner. This optional feature of PLC circuit 200 is implemented, for example, in the preferred embodiment described in FIG. 12 (discussed in further detail herein).

In several of the specific preferred embodiments described in further detail herein (i.e., with reference to FIGS. 6, 7, 9, 11, and 12), power supply circuit 920 is an electronic ballast, power processing circuitry 940 includes an inverter, and load 960 consists of at least one gas discharge lamp.

Arrangement 900 operates according to a method that is now described with reference to FIG. 5.

Figure 5:
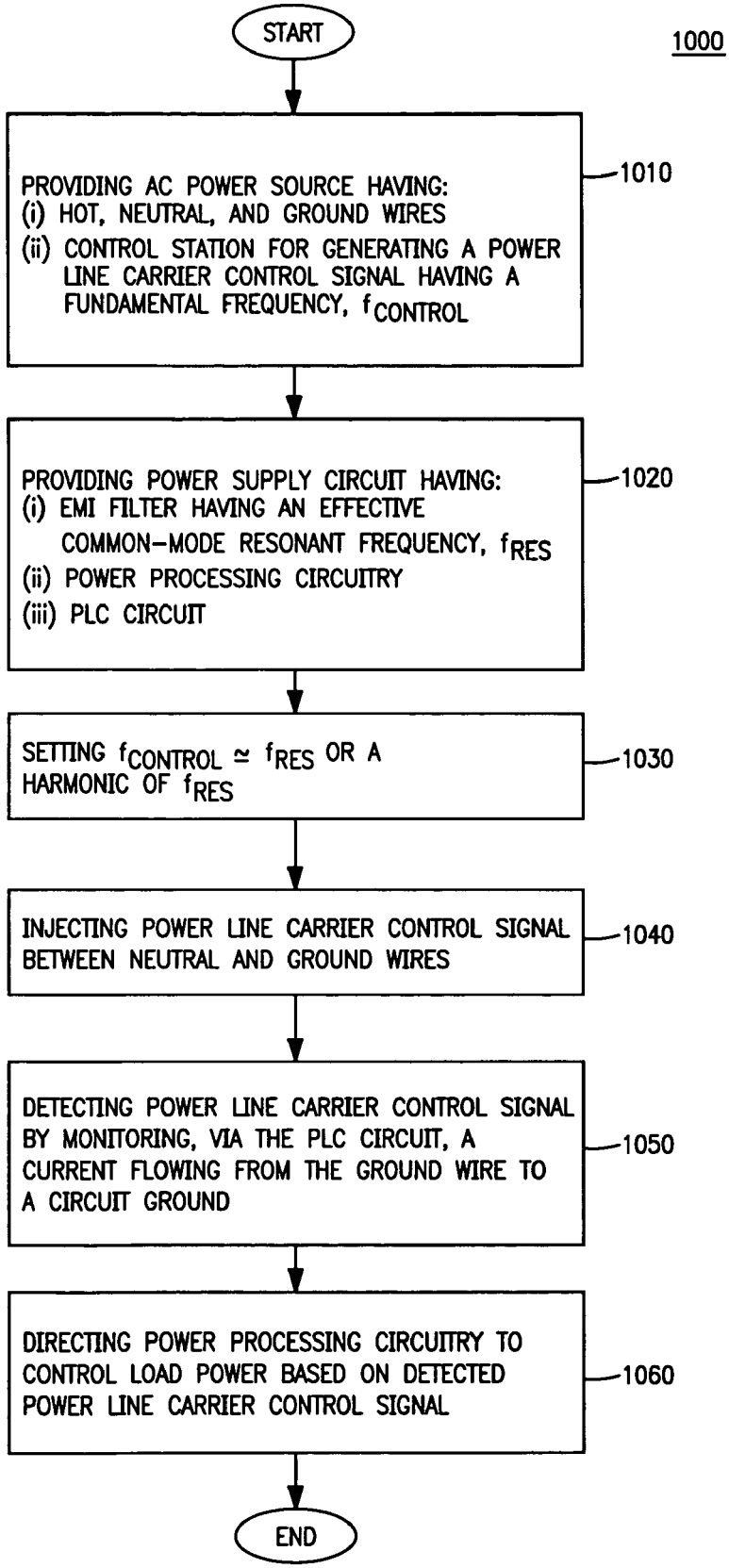
FIG. 5 is a flowchart that describes a power line communication method, in accordance with the preferred embodiments of the present invention.

FIG. 5 describes a method 1000 for providing power line communication from an alternating current (AC) power source to a circuit for supplying power to a load. Method 1000 includes the following steps:

(1) providing (1010) an AC power source having: (i) hot, neutral, and ground wires; and (ii) a control station for generating a power line carrier control signal having a fundamental frequency ($f_{CONTROL}$);

(2) providing (1020) a power supply circuit having: (i) an electromagnetic interference (EMI) filter coupled to the AC power source and having an effective resonant frequency, $f_{RES}$; (ii) power processing circuitry coupled between the EMI filter and the load; and (iii) a power line communication (PLC) circuit coupled to the EMI filter and the power processing circuitry;

(3) setting (1030) the fundamental frequency, $f_{CONTROL}$, of the power line carrier control signal to be approximately equal to either: (i) the effective common-mode resonant frequency, $f_{RES}$, of the EMI filter; or (ii) a harmonic of $f_{RES}$;

(4) injecting (1040), by way of the control station, a power line carrier control signal between the neutral wire and the ground wire of the AC power source;

(5) detecting (1050) the power line carrier control signal by monitoring, via the PLC circuit, a current flowing from the ground wire of the AC power source to a circuit ground; and (6) directing (1060), by way of the PLC circuit, the power processing circuitry to control the power supplied to the load in dependence on the detected power line carrier control signal.

Preferably, the step of directing (1060) includes directing the power processing circuitry to control the load power in dependence on both: (i) the detected power line carrier control signal; and (ii) timing of the detected power line carrier control signal with respect to a phase of the voltage, $V_{AC}$, provided by the AC power source between the hot wire and the neutral wire. More specifically, if the power line carrier control signal occurs during a positive half cycle of $V_{AC}$, then the PLC circuit directs the power processing circuitry to control the load power in a first manner; conversely, if the power line carrier control signal occurs during a negative half cycle of $V_{AC}$, then the PLC circuit directs power processing circuitry to control the load power in a second manner. This optional feature of method 1000 is implemented, for example, in the preferred embodiment described in FIG. 13 (discussed in further detail herein).

Method 1000 is advantageously implemented in an arrangement wherein the circuit for supplying power to the load is an electronic ballast, and in which the load consists of at least one gas discharge lamp.

Preferred embodiments in which arrangement 900 and method 1000 are realized by electronic ballast circuits are now described with reference to FIGS. 6-12 as follows.

Figure 6:
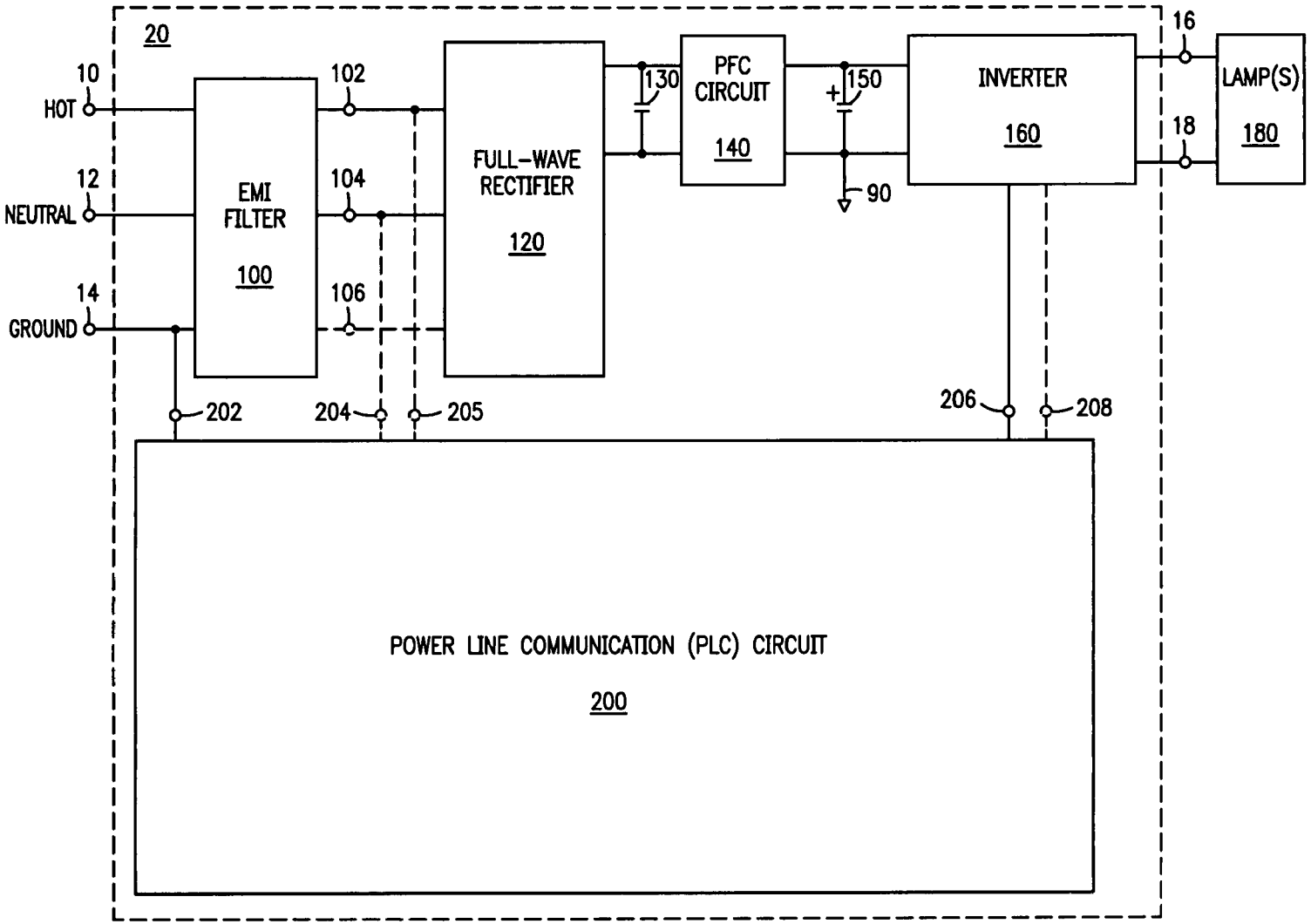
FIG. 6 is a block-diagram schematic of an electronic ballast with a power line communication (PLC) circuit, in accordance with the preferred embodiments of the present invention.

FIG. 6 describes a ballast 20 for powering one or more gas discharge lamps 180. Ballast 20 includes an electromagnetic interference (EMI) filter 100, a full-wave rectifier 120, a first capacitor 130, a power factor correction (PFC) circuit 140, a second capacitor 150, an inverter 160, and a power line communication (PLC) circuit 200. Full wave rectifier 120, PFC circuit 140, and inverter 160 are each coupled to circuit ground 90.

EMI filter 100 has first, second, and third input connections 10,12,14 and first and second output connections 102,104. First input connection 10 is adapted for coupling to a hot wire of an alternating current (AC) power line voltage, such as that which is ordinarily provided by an electric utility (e.g., 120 volts rms at 60 hertz). Second input connection 12 is adapted for coupling to a neutral wire of the AC power source, while third input connection 14 is adapted for coupling to a ground wire of the AC power source. EMI filter 100 optionally includes a third output connection 106 (denoted by dashed lines in FIG. 6). During operation, EMI filter 100 serves to reduce/suppress any high frequency line-conducted interference that may be generated by operation of certain circuitry (e.g., PFC circuit 140 and inverter 160) within ballast 20.

Full-wave rectifier 120 is coupled to the first and second output connections 102,104 of EMI filter 100. Optionally, when EMI filter 100 includes a third output connection 106, full-wave rectifier 120 is also coupled to third output connection 106. During operation, full-wave rectifier receives the sinusoidal AC voltage provided between output connections 102,104 and provides a full-wave rectified AC voltage across capacitor 130, which functions as a high frequency filtering capacitor.

Power factor correction (PFC) circuit 140 is coupled to full-wave rectifier 120 and capacitor 130. During operation, PFC circuit 140 receives the full-wave rectified AC voltage from full-wave rectifier 120 and provides a substantially direct current (DC) voltage across capacitor 150. Capacitor 150 functions as a low frequency filtering capacitor for minimizing any low frequency (e.g., 120 hertz) ripple in the voltage provided by PFC circuit 140; although depicted in FIG. 6 as a single capacitor, it should be appreciated that capacitor 150 may (depending on the AC line voltage and the number of lamps in the lamp load 180) be realized by multiple capacitors connected in series or parallel arrangements. PFC circuit 140 also operates to ensure that the current drawn by ballast 20 from the AC power line is substantially sinusoidal (i.e., with a low harmonic distortion) and substantially in-phase with the AC power line voltage (i.e., with a high power factor). PFC circuit 140 may be realized by any of a number of suitable arrangements (e.g., a boost converter) that are well known to those skilled in the art.

Inverter 160 is coupled to PFC circuit 140 and capacitor 150. Inverter 160 has first and second output connections 16,18 that are adapted for coupling to lamp(s) 180. Although depicted in FIG. 6 as having two output connections 16,18, it should be understood that inverter 160 may include additional output connections (depending on the number of lamps and the connection arrangement of the lamps). During operation, inverter 160 receives the substantially DC voltage from PFC circuit 140 and provides a high voltage for igniting, and a magnitude-limited current for operating, lamp(s) 180; preferably, the voltage and current provided to lamp(s) 180 by inverter 160 has a frequency higher than the effective common-mode resonant frequency, $f_{RES}$, of EMI filter 100. Inverter 160 may be realized by any of a number of suitable arrangements (e.g., a driven bridge type inverter combined with a resonant output circuit) that are well known to those skilled in the art. Although not explicitly described in FIG. 6, it should be understood that inverter 160 includes some form of drive circuitry that controls the operation of inverter 160 and, thereby, the magnitude of the operating current provided to lamp(s) 180. Additionally, it should be understood that the drive circuitry of inverter 160 is capable of providing dimming of lamp(s) 180 in response to a control signal provided to inverter 160.

Power line communication (PLC) circuit 200 includes a first input terminal 202 and a first output terminal 206. First input terminal 202 is coupled to the ground wire of the AC power source via third input connection 14 of EMI filter 100. First output terminal 206 is coupled to inverter 160; more specifically, in practice, first output terminal 206 is coupled to the drive circuitry (not shown in FIG. 6) that controls the operation of inverter 160. The drive circuitry within inverter 160 may include a custom integrated circuit or a microprocessor. PLC circuit 200 optionally includes (as depicted by dashed lines in FIG. 6) second and third input terminals 204,205 and a second output terminal 208.

During operation, PLC circuit 200 is capable of controlling operation of inverter 160 in accordance with a power line carrier control signal that is applied (e.g., by the electric utility company) between the neutral and ground wires of the AC power source. For example, in response to a power line carrier control signal corresponding to a load shed command, PLC circuit 200 directs inverter 160 to reduce the illumination level of the lamp(s) 180 from a full light output level (e.g., 100% of rated light output) to a predetermined reduced output level (e.g., 65% of rated light output).

Advantageously, PLC circuit 200 utilizes an effective common-mode resonant frequency, $f_{RES}$, of EMI filter 100 to detect and amplify the power line carrier control signal. To provide this benefit, the fundamental frequency, $f_{CONTROL}$, of the power line carrier control signal, $V_{CONTROL}$, is selected to be approximately equal to the effective common-mode resonant frequency, $f_{RES}$, of EMI filter 100; for reference, $f_{RES}$ typically ranges between 10,000 hertz and 25,000 hertz. Consequently, PLC circuit 200 may be realized with a relatively modest number of components and in a highly cost-effective and space-efficient manner.

Figure 7:
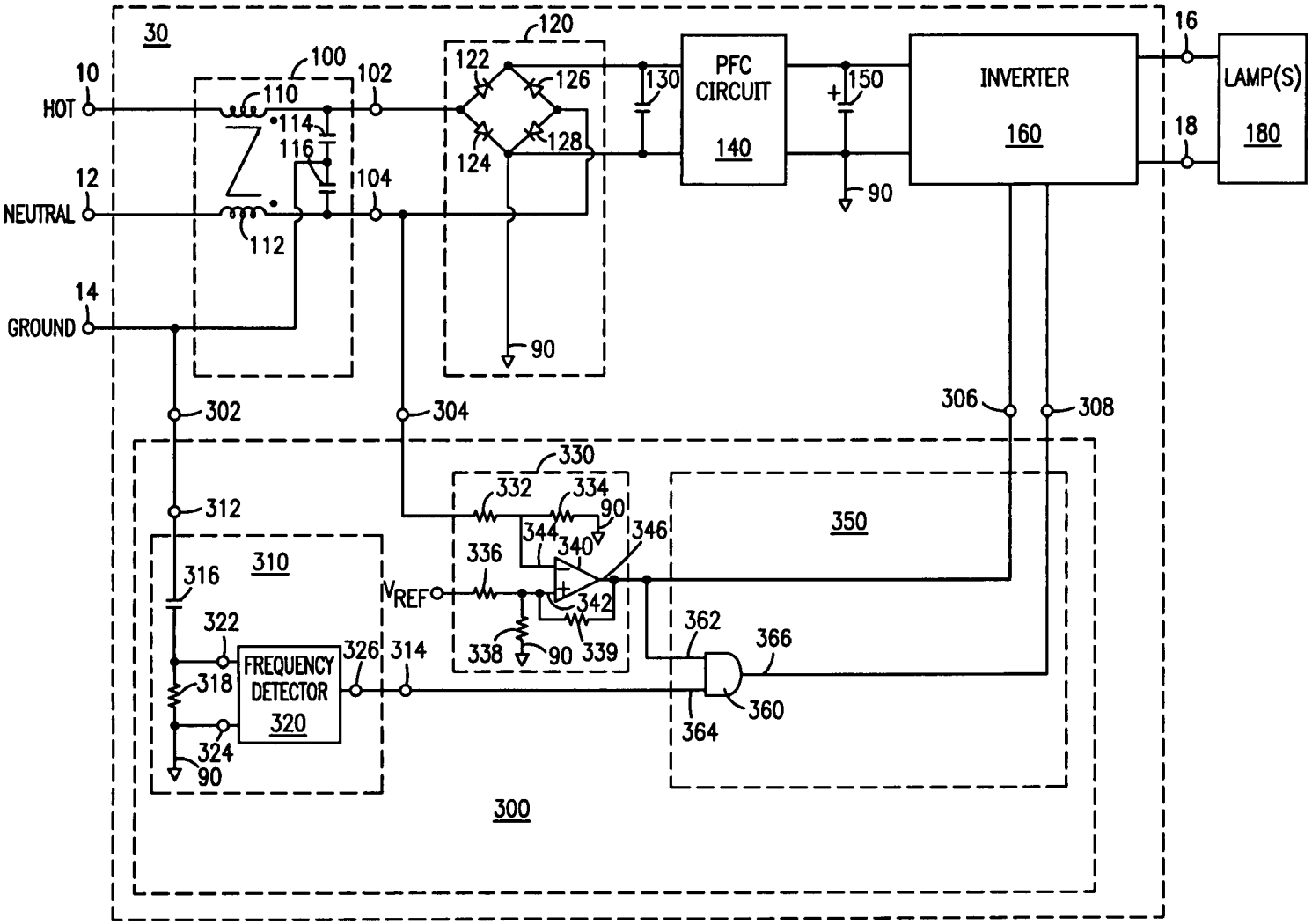
FIG. 7 is a partial block-diagram schematic of an electronic ballast with a power line communication circuit, in accordance with a first specific preferred embodiment of the present invention.

FIG. 7 describes a ballast 30 that is configured in accordance with a first specific preferred embodiment of the present invention.

Figure 1:
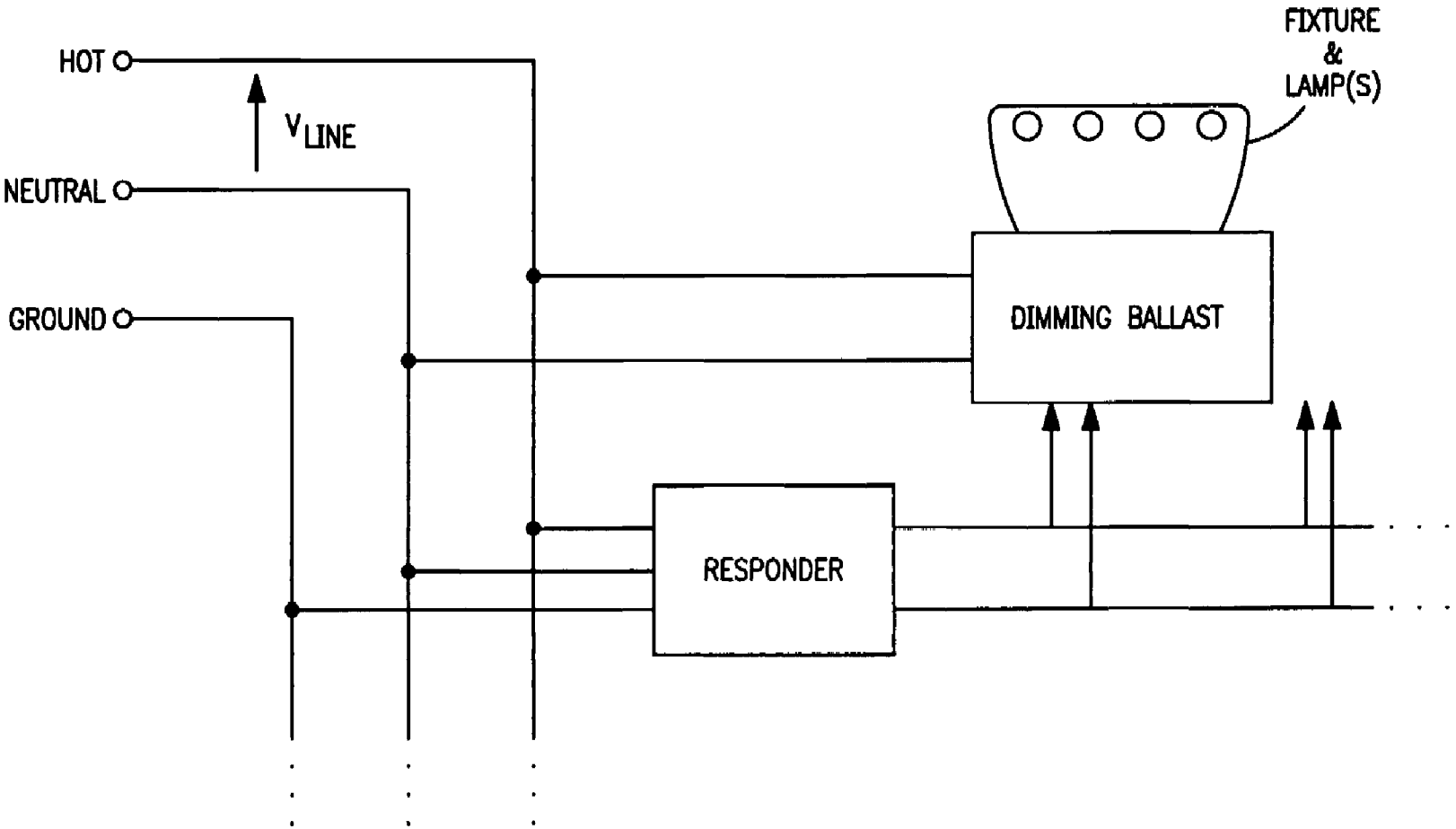
FIG. 1 PRIOR ART
FIG. 1 describes a prior art arrangement for providing power line communication from an AC power source to one or more dimming ballasts for powering gas discharge lamps.
Figure 2:
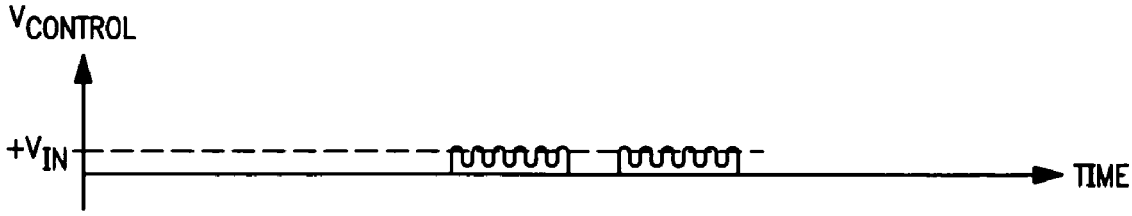
FIG. 2 PRIOR ART
FIG. 2 describes a typical carrier control signal that is generated by the AC power source in the prior art arrangement of FIG. 1.

EMI filter 100 comprises first, second, and third input connections 10,12,14, first and second output connections 102,104, first and second inductors 110,112 (commonly collectively referred to as a "common mode inductor") and first and second capacitors 114,116 (commonly referred to as "Y-capacitors"). First, second, and third input connections 10,12,14 are adapted for coupling, respectively, to the hot, neutral, and ground wires of the AC power source. First and second output connections are coupled to full-wave rectifier 120. First inductor 110 is coupled between first input connection 10 and first output connection 102. Second inductor 112 is coupled between second input connection 12 and second output connection 104, and is magnetically coupled to first inductor 110. Inductors 110,112 are orientated, with respect to each other, as indicated by the dots shown in FIG. 2. First capacitor 114 is coupled between first output connection 102 and third input connection 14. Second capacitor 116 is coupled between third input connection 14 and second output connection 104.

Full-wave rectifier 120 is preferably realized by a diode bridge comprising first, second, third, and fourth diodes 122, 124,126,128 connected in the manner described in FIG. 7.

Referring to FIG. 7, PLC circuit 300 comprises first and second input terminals 302,304, first and second output terminals 306,308, a signal detector circuit 310, a phase detector circuit 330, and a logic circuit 350. First input terminal 302 is coupled to the ground wire of the AC power source via third input connection 14 of EMI filter 100. Second input terminal 304 is coupled to second output connection 104 of EMI filter 100. First and second output terminals 306,308 are coupled to inverter 160.

Referring again to FIG. 7, signal detector circuit 310 preferably includes an input 312, an output 314, a capacitor 316, a resistor 318, and a frequency detector 320 having a first input 322, a second input 324, and an output 326. Resistor 318 is a low value resistor (e.g., having a resistance on the order of no more than several ohms) that operates to detect high frequency current that flows to circuit ground 90 when a power line carrier control signal is present. Frequency detector 320 may be implemented by a LM567 integrated circuit that is tuned to the fundamental frequency of the power line carrier control signal. In response to a sufficient voltage across resistor 318 (which occurs when a power line carrier control signal is applied between the neutral and ground wires of the AC power source), frequency detector 320 provides a signal at output 326 that corresponds to a logic "1". Input 312 is coupled to first input terminal 302 of PLC circuit 300. Output 314 is coupled to logic circuit 350. First capacitor 316, which serves as a decoupling capacitor, is coupled between input 312 and first input 322 of frequency detector 320. Resistor 318 is coupled between first and second inputs 322,324 of frequency detector 320. Second input 324 of frequency detector 320 is coupled to circuit ground 90. Output 326 of frequency detector 320 is coupled to output 314 of signal detector circuit 310. Advantageously, because second input 324 of frequency detector 320 is coupled to circuit ground 90, there is no need for additional circuitry to provide electrical isolation between signal detector circuit 310 and the rest of the circuitry within PLC circuit 300 and ballast 30.

During operation, when an appropriate power line carrier control signal is applied between the neutral and ground wires of the AC power source, signal detector circuit 310 provides a predetermined voltage (i.e., corresponding to a logic "1") at output 314. EMI filter 100 prevents signals (i.e., common-mode noise that occurs within ballast 30) with frequencies other than the fundamental frequency of the power line carrier control signal from developing a significant voltage across resistor 318.

As described in FIG. 7, phase detector circuit 330 comprises an operational amplifier (op amp) 340, and first, second, third, fourth, and fifth resistors 332,334,336,338,339. Op amp 340 has a non-inverting input 342, an inverting input 344, and an output 346. Output 346 of op amp 340 is coupled to first output terminal 306 of PLC circuit 300 via logic circuit 350. First resistor 332 is coupled between second input terminal 304 (of PLC circuit 300) and inverting input 344 (of op amp 340). Second resistor 334 is coupled between inverting input 344 and circuit ground 90. Third resistor 336 is coupled between a reference voltage, $V_{REF}$, and non-inverting input 342. Fourth resistor 338 is coupled between non-inverting input 342 and circuit ground 90. Fifth resistor 339 is coupled between non-inverting input 342 and output 346 of op amp 340.

During operation, phase detector circuit 330 functions as a near zero-crossing detector that provides an output signal in dependence on the phase (i.e., positive half cycle or negative half cycle) of the voltage, $V_{AC}$, between the hot and neutral wires of the AC power source. Within phase detector circuit 300, inverting input 344 of op amp 340 sees a scaled-down (via the voltage divider action provided by resistors 332,334) version of the half-wave rectified AC voltage that is present between the neutral wire of the AC source and circuit ground 90, while non-inverting input 342 of op amp 340 sees a scaled-down (via the voltage divider action provided by resistors 336,338) version of $V_{REF}$. The output 346 of op amp 340 is low (i.e., at about zero volts) when the voltage at inverting input 344 is higher than the voltage at non-inverting input 342; conversely, the output 346 of op amp 340 is high (e.g., at about +5 volts or so) when the voltage at non-inverting input 342 is higher than the voltage at inverting input 344. During the positive half cycles of $V_{AC}$, approximately zero volts are present at second input terminal 304, so the voltage at inverting input 344 is likewise approximately zero; conversely, during the negative half cycles of $V_{AC}$, the voltage at second input terminal 304 is positive and nonzero, so the voltage at inverting input 344 exceeds the voltage at non-inverting input 342 for most of the duration of the negative half cycles. Thus, the output 346 of op amp 340 is high (i.e., at about +5 volts) during positive half cycles of the AC power line voltage, and is low (i.e., at about zero volts) during negative half cycles of the AC power line voltage. In this way, phase detector circuit 330 provides an output signal that is indicative of the phase of $V_{AC}$.

Referring again to FIG. 7, logic circuit 350 comprises an AND gate 360 having a first input 362, a second input 364, and an output 366. First input 362 is coupled to output 346 of op amp 340 within phase detector circuit 330. Second input 364 is coupled to output 314 of signal detector circuit 310. Output 366 of AND gate 360 is coupled to second output terminal 308 of PLC circuit 300. During operation, logic circuit 350 provides a logic signal at second output terminal 308 in accordance with the power line carrier control signal and the phase of the voltage ($V_{AC}$) between the hot and neutral wires of the AC power source. More specifically, logic circuit 350 provides a logic "1" at output terminal 308 only when the following two conditions occur: (i) a power line carrier control signal is present and detected; and (ii) $V_{AC}$ is in a positive half cycle. Otherwise, logic circuit 350 provides a logic "0" at output terminal 308.

Figure 8:
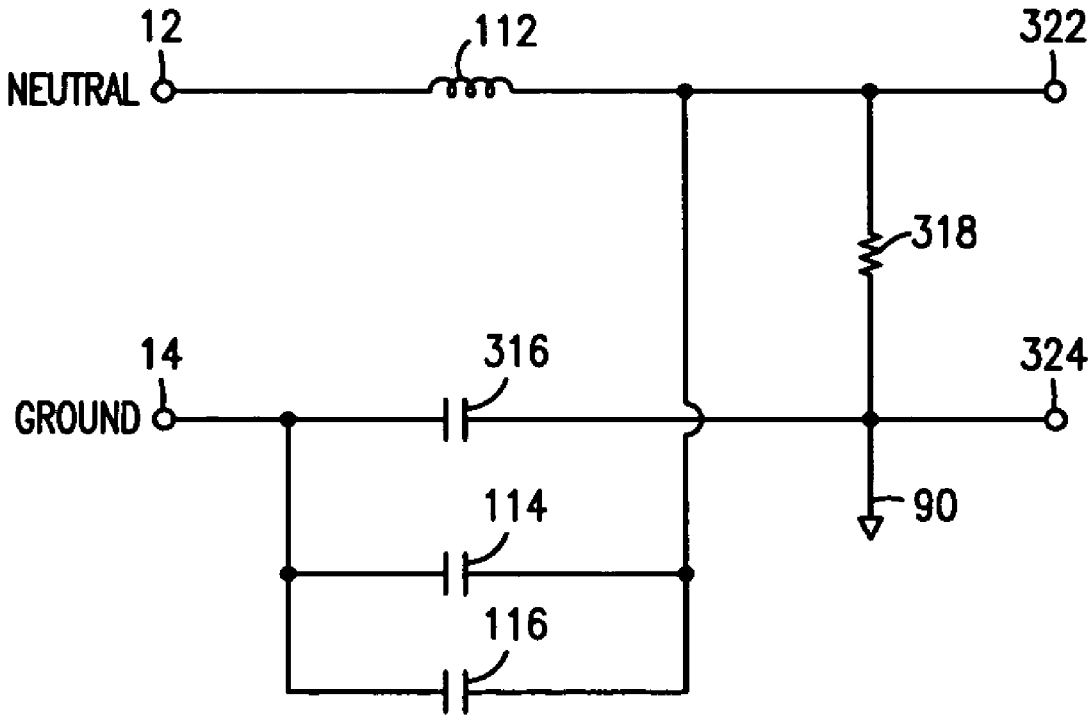
FIG. 8 describes an equivalent circuit for the EMI filter and a portion of the PLC circuit in the electronic ballast depicted in FIG. 7, in accordance with the first specific preferred embodiment of the present invention.

FIG. 8 describes a simplified equivalent circuit for EMI filter 100 and a portion of signal detector circuit 310. It can seen from FIG. 8 that the equivalent circuit effectively functions as a series LC resonant circuit in which the inductance of winding 112 (of EMI filter 100 in FIG. 7) constitutes the equivalent series inductance, $L_{EQ}$, and the sum of the capacitances of Y-capacitors 114,116 constitutes the equivalent series capacitance, $C_{EQ}$. The simplified equivalent circuit of FIG. 8 assumes that the conduction angle of the diodes 122, 124,126,128 in full-wave rectifier 120 is substantially 180 degrees and that each of diodes 122,124,126,128, during their respective conduction intervals, effectively present zero impedance at the fundamental frequency, $f_{CONTROL}$, of the power line carrier control signal, $V_{CONTROL}$. EMI filter 100 functions as a bandpass filter for the incoming control signal attributable to $V_{CONTROL}$, in which the carrier frequency, $f_{CONTROL}$, corresponds to the effective common-mode resonant frequency, $f_{RES}$, of EMI filter 100. For purposes of practicing the present invention, it is important that the natural resonant frequency of the series resonant circuit formed by $L_{EQ}$ and $C_{EQ}$ should be approximately equal to the power line carrier frequency, $f_{CONTROL}$, or a harmonic thereof. Thus, EMI filter 100 functions as a bandpass filter that allows only those signals with a fundamental frequency equal to about $f_{CONTROL}$ to pass substantially unattenuated to the inputs 322, 324 of frequency detector 320; conversely, signals with a fundamental frequency that is substantially different from $f_{CONTROL}$ (i.e., signals due to noise or other disturbances in the AC wiring or within ballast 30) are significantly attenuated before reaching the inputs 322,324 of frequency detector 320.

In this way, EMI filter 100 and signal detector circuit 310 operate together to detect a legitimate power line carrier control signal, while rejecting noise and other spurious signals.

Figure 9:
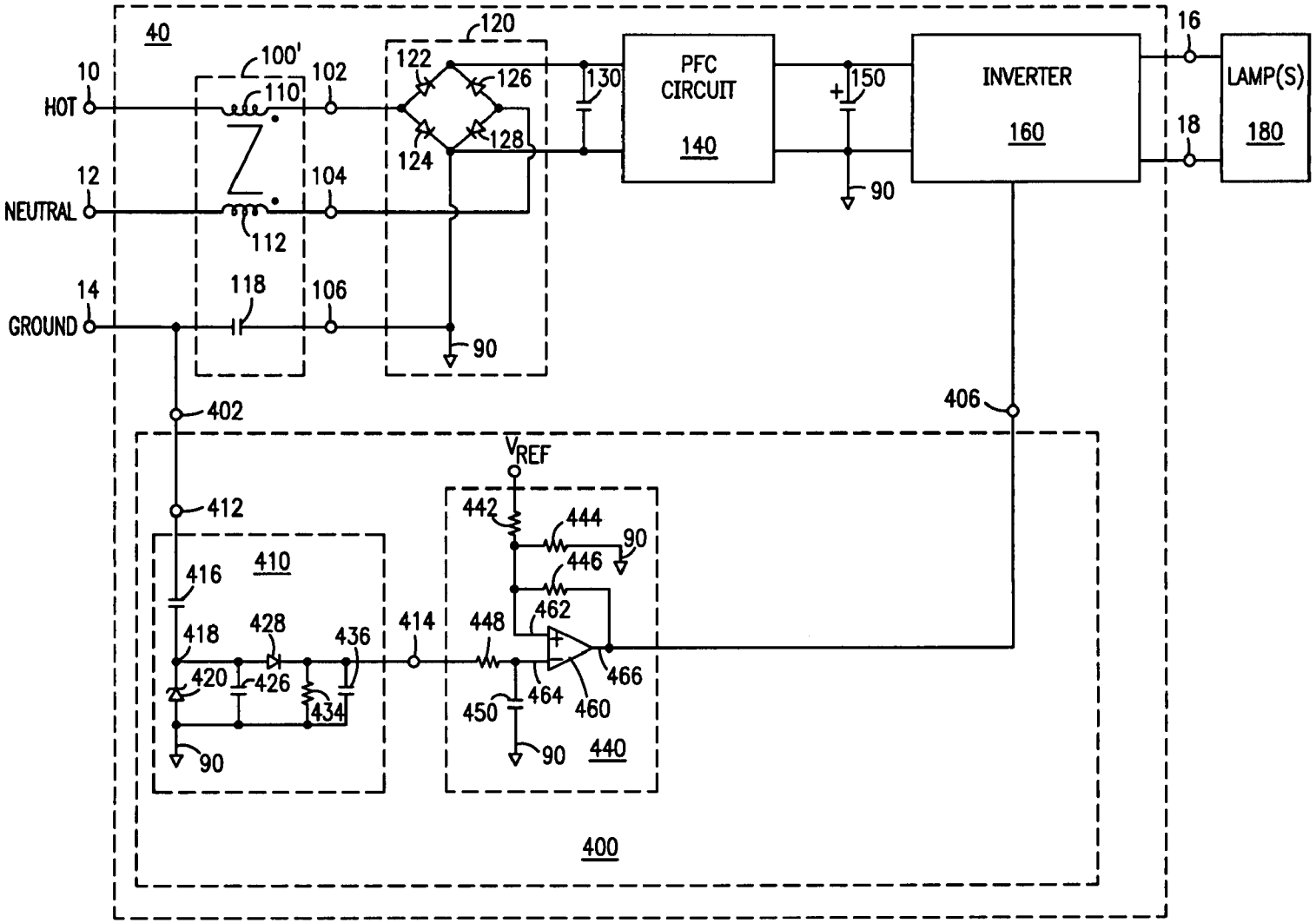
FIG. 9 is a partial block-diagram schematic of an electronic ballast with a power line communication circuit, in accordance with a second specific preferred embodiment of the present invention.

In a second specific preferred embodiment of the present invention, as described in FIG. 9, a ballast 40 includes a modified EMI filter 100' and a simplified PLC circuit 400. Ballast 40 is well suited for more basic control applications, such as simple load shedding (wherein, in response to a power line carrier control signal corresponding to a load shed command, the inverter is directed to reduce the light output of the lamp(s) from a full light output level to a predetermined reduced light output level), in which the PLC circuit need only provide a single bit output signal to the inverter.

EMI filter 100' comprises first, second, and third input connections 10,12,14, first, second, and third output connections 102,104,106, first and second magnetically coupled inductors 110,112 (commonly collectively referred to as a "common mode inductor"), and a capacitor 118 (commonly referred to as a "Y-capacitor"). First, second, and third input connections 10,12,14 are adapted for coupling, respectively, to the hot, neutral, and ground wires of the AC power source. First, second, and third output connections are coupled to full-wave rectifier circuit 120. First inductor 110 is coupled between first input connection 10 and first output connection 102. Second inductor is coupled between second input connection 12 and second output connection 104, and is magnetically coupled to first inductor 110. Inductors 110,112 are orientated, with respect to each other, as indicated by the dots shown in FIG. 9. Capacitor 118 is coupled between third input connection 14 and third output connection 106.

Figure 3:
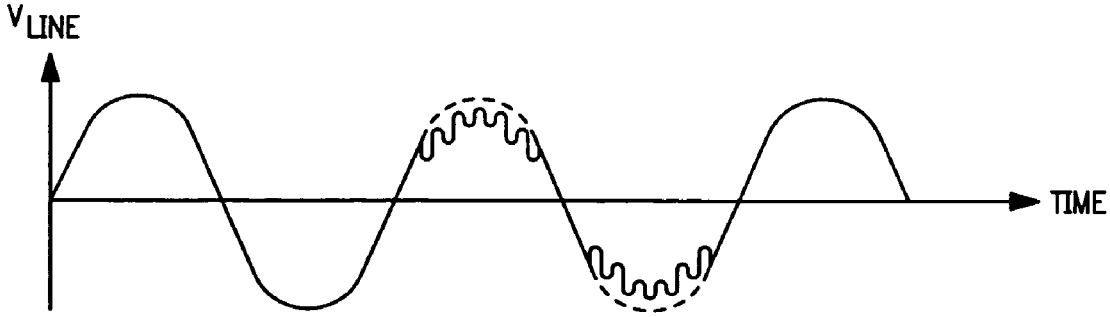
FIG. 3 PRIOR ART
FIG. 3 describes a typical line voltage provided by the AC power source in the prior art arrangement of FIG. 1.

Full-wave rectifier 120 is preferably realized by a diode bridge comprising first, second, third, and fourth diodes 122, 124,126,128 connected in the manner described in FIG. 3.

PLC circuit 400 comprises an input terminal 402, an output terminal 406, 15, a signal detector circuit 410, and a comparator circuit 440. Input terminal 402 is coupled to the ground wire of the AC power source via third input connection 14 of EMI filter 100'. Output terminal 406 is coupled to inverter 160.

Referring again to FIG. 9, signal detector circuit 410 is realized as an amplitude modulation (AM) detector circuit (in contrast with the signal detector circuit 310, which is realized as a frequency detection circuit). Signal detector circuit 410 comprises an input 412, an output 414, a first capacitor 416, a zener diode 420, a second capacitor 426, a diode 428, a resistor 434, and a third capacitor 436. First capacitor 416, which functions as a decoupling capacitor, is coupled between input 412 and a first node 418. Zener diode 420 and capacitor 426 are each coupled between first node 418 and circuit ground 90. Zener diode 420 effectively limits the voltage that can appear at output 414. Second capacitor 426 is preferably chosen to have a relatively small capacitance (e.g., on the order of tens of picofarads), and functions to suppress any high frequency (i.e., at frequencies higher than $f_{CONTROL}$) common-mode noise current. Diode 428 is coupled between first node 418 and output 414. Resistor 324 and third capacitor 436 are each coupled between output 414 and circuit ground 90. Resistor 324 serves as a loading resistor, and third capacitor 436 functions as a filtering capacitor.

During operation, signal detector circuit 410 functions as a charge pump circuit that provides a predetermined voltage at output 414 when a suitable power line carrier control signal is applied between the neutral and ground wires of the AC power source. More specifically, signal detector circuit 410 rectifies and filters the voltage at input 402 which, when a power line carrier control signal is present, consists of an amplified control signal combined with a common-mode noise signal. Stated another way, signal detector circuit 410 provides an output voltage (at output 414) which is approximately proportional to the high frequency current which flows to circuit ground 90. However, EMI filter 100' provides a high Q factor (e.g., 8-10, or so) at the fundamental frequency of the power line carrier control signal (which follows from the fact that the fundamental frequency, $f_{CONTROL}$, of the power line carrier control signal, $V_{CONTROL}$, is approximately equal to an effective common-mode resonant frequency of EMI filter 100'); consequently, in the signal provided to input 412 of signal detector circuit 410, the portion of the signal that is attributable to the power line carrier control signal is substantially greater than the portion that is attributable to the common-mode noise signal.

As described in FIG. 9, comparator circuit 440 comprises an operational amplifier (op amp) 460, first, second, third, and fourth resistors 442,444,446,448, and a capacitor 450. Op amp 460 has a non-inverting input 462, an inverting input 464, and an output 466. Output 466 of op amp 460 is coupled to output connection 406 of PLC circuit 400. First resistor 442 is coupled between a reference voltage, $V_{REF}$, and non-inverting input 462. Second resistor 444 is coupled between non-inverting input 462 and circuit ground 90. Third resistor 446 is coupled between non-inverting input 462 and output 466 of op amp 460. Fourth resistor 448 is coupled between output 414 of signal detector circuit 410 and inverting input 464. Capacitor 450 is coupled between inverting input 464 and circuit ground 90.

During operation, comparator circuit 440 provides a logic signal (i.e., a logic "0" or a logic "1") at output terminal 406 in accordance with the power line carrier control signal as detected by signal detector circuit 410. More specifically, if a power line carrier control signal of sufficient amplitude (e.g., 1-1.5 volts rms) is applied between the neutral and ground wires of the AC power source, the voltage at inverting input 464 exceeds the voltage at non-inverting input 462; consequently, a step signal is generated at output 466 of comparator 460, which causes inverter 160 to reduce the current supplied to lamp(s) 180. Conversely, in the absence of a power line carrier control signal of sufficient amplitude, the voltage at non-inverting input 462 exceeds the voltage at inverting input 464; consequently, a reverse step signal is present at output 466 of comparator 460, which causes inverter 160 to apply full current to lamp(s) 180. Positive feedback, which is provided by way of resistor 446, allows comparator circuit 440 to operate with rapid switching and with hysteresis. Resistor 448 and capacitor 450 together function as an integrator circuit which protects against false tripping (i.e., the output 466 of op amp 460 incorrectly transitioning from a logic "1" to a logic "0") due to low frequency noise/transients in the AC power line voltage and/or other occurrences of noise within ballast 40.

Preferred nominal values for certain components and signals in ballast 40 are now recited as follows. Within EMI filter 100', inductors 110,112 preferably have an inductance of 15 millihenries, and capacitor 118 preferably has a capacitance of 3300 picofarads. Within signal detector circuit 410, capacitor 416 preferably has a capacitance of 470 picofarads, resistor 434 preferably has a resistance of 51 kilohms, and capacitor 436 preferably has a capacitance of 0.1 microfarad. Within comparator circuit 440, resistor 448 preferably has a resistance of 1 megohms, and capacitor 450 preferably has a capacitance of 1 microfarad. $V_{REF}$ and the resistances of resistors 442,444 are preferably set such that the voltage at non-inverting input 462 of op amp 460 is at about 8.3 volts.

It should be appreciated that, in ballast 40, a considerable amount of common-mode noise (attributable to operation of PFC circuit 140 and inverter 160) is encountered by signal detector circuit 410. That noise, which may produce a voltage on the order of several volts at the output 414, is readily accepted by capacitor 416. Moreover, the common-mode noise attributable to operation of PFC circuit 140 is not evenly distributed throughout the cycles of the AC voltage, $V_{AC}$, provided between the hot and neutral wires of the AC power source; rather, that common-mode noise has a significant burst at those points where $V_{AC}$ passes through zero (commonly referred to as the "zero crossings" of $V_{AC}$). As a result, the output of signal detector circuit 410 may be somewhat distorted. While distortion due to common-mode noise does not appear to unfavorably affect the operation of comparator circuit 440, it does constitute a significant potential problem for a ballast in which multi-bit power line communication (as opposed to single bit power line communication, as in ballast 40) is desired or required.

Figure 10:
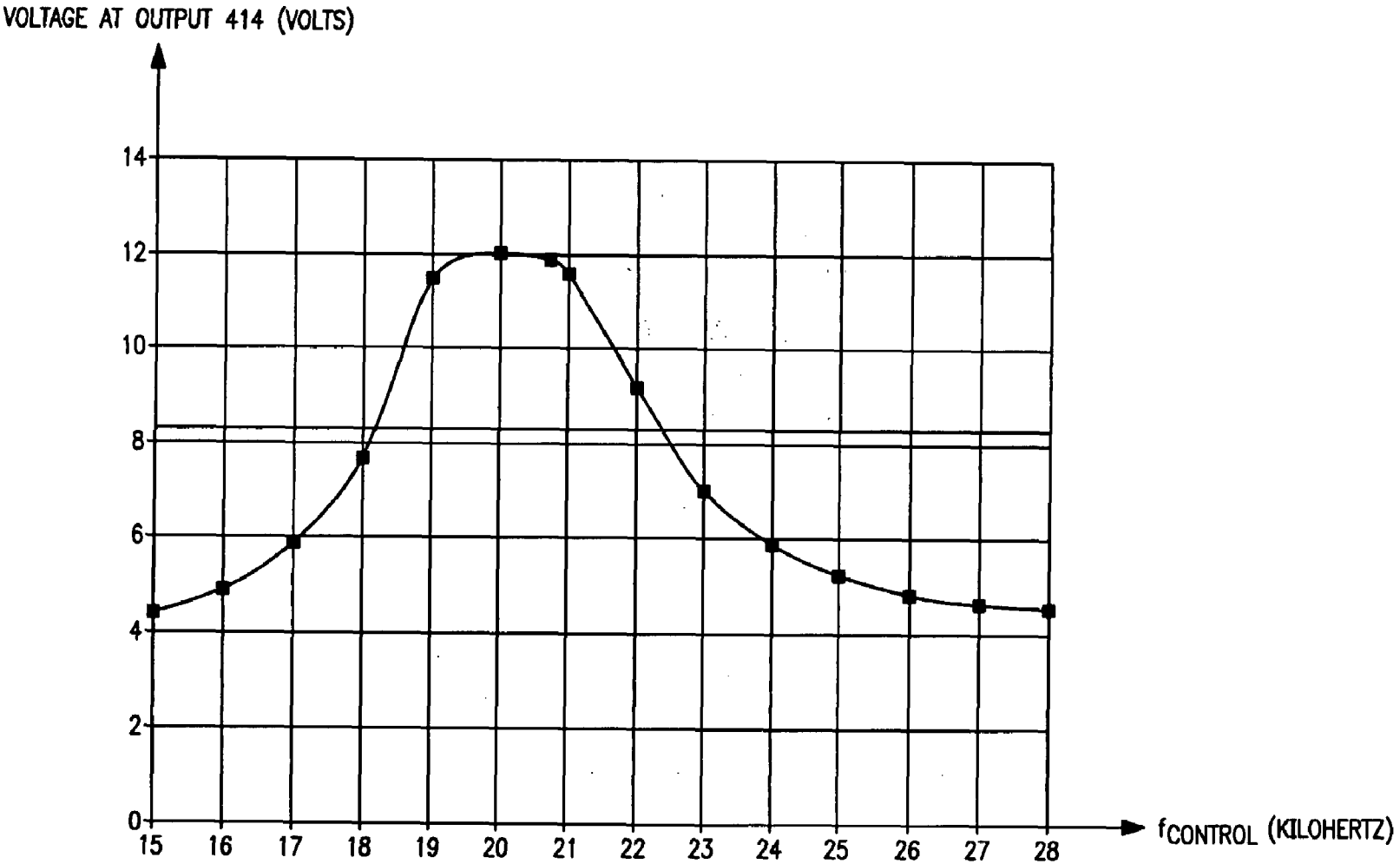
FIG. 10 is a plot illustrating a preferred relationship between detector output voltage and the fundamental frequency of the power line carrier control signal for the electronic ballast described in FIG. 9, in accordance with the second specific preferred embodiment of the present invention.

FIG. 10 is a typical frequency response plot of the voltage at output 414 of signal detector circuit 410 (as described in FIG. 9) when the effective resonant frequency of EM I circuit 100' is set at 20 kilohertz. It can be seen from FIG. 10 that signal detector circuit 410 provides its highest DC output voltage when the power line carrier frequency, $f_{CONTROL}$, is at 20 kilohertz (which corresponds to the effective common-mode resonant frequency, $f_{RES}$, of the EMI filter as typically implemented in a conventional T8 lamp ballast manufactured by Osram Sylvania Products, Inc.) The highest DC output voltage is limited to 12 volts due to clamping action by zener diode 420. Any voltage which occurs at output 414 due to frequencies other than $f_{CONTROL}$ is attributable to common-mode noise, and is attenuated (within comparator circuit 440) by applying a portion of reference voltage, $V_{REF}$, to non-inverting input 462 of op amp 460; to achieve this attenuation, it is necessary that, when a power line carrier control signal is absent, the voltage at non-inverting input 462 must be higher than the voltage at inverting input 464. It should be appreciated that the frequency response plot of FIG. 10 is also applicable to the third and fourth specific preferred embodiments described below with reference to FIGS. 11 and 12, as the ballasts for those preferred embodiments employ EMI filters and signal detector circuits having essentially the same structure as EMI filter 100' and signal detector circuit 410.

Figure 11:
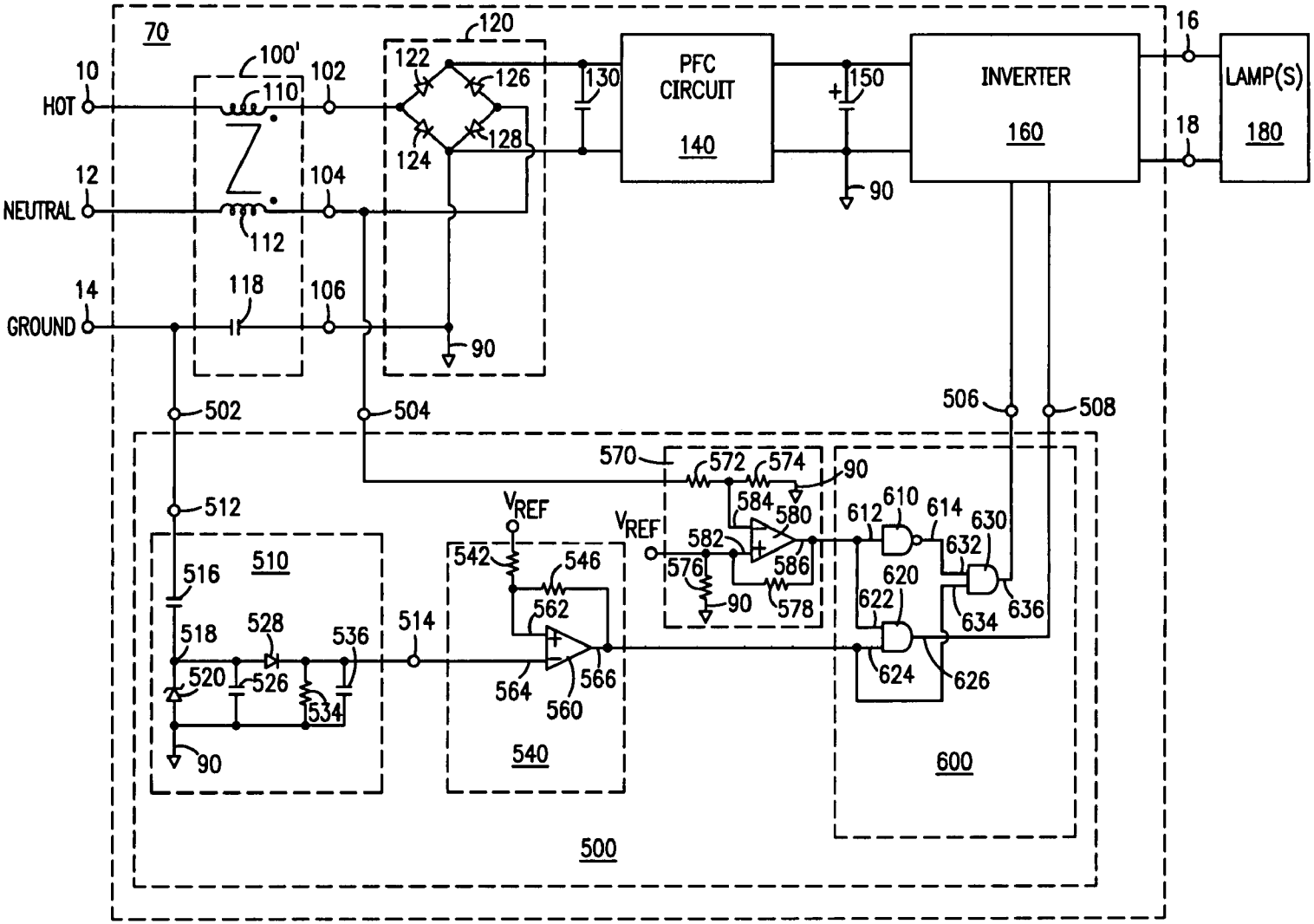
FIG. 11 is a partial block-diagram schematic of an electronic ballast with a power line communication circuit, in accordance with a third specific preferred embodiment of the present invention.

FIG. 11 describes a ballast 70 that is configured in accordance with a third specific preferred embodiment of the present invention.

EMI filter 100' and full-wave rectifier 120 are preferably realized with the same structures previously described with reference to FIG. 9. However, the structure and operation of PLC circuit 500 are somewhat different from the circuits that have been previously described above.

PLC circuit 500 comprises first and second input terminals 502,504, first and second output terminals 506,508, a signal detector circuit 510, a comparator circuit 540, a phase detector circuit 570, and a logic circuit 600. First input terminal 502 is coupled to the ground wire of the AC power source via third input connection 14 of EMI filter 100'. Second input terminal 504 is coupled to second output connection 104 of EMI filter 100'. First and second output terminals 506,508 are coupled to inverter 160.

Referring to FIG. 11, signal detector circuit 510 comprises an input 512, an output 514, a first capacitor 516, a zener diode 520, a second capacitor 526, a diode 528, a resistor 534, and a third capacitor 536. First capacitor 516, which functions as a decoupling capacitor, is coupled between input 512 and a first node 518. Zener diode 520 and capacitor 526 are each coupled between first node 518 and circuit ground 90. Diode 528 is coupled between first node 518 and output 514. Resistor 543 and capacitor 536 are each coupled between output 514 and circuit ground 90. The structure and operation of signal detector circuit 510 are the same as that which was previously described with reference to signal detector circuit 410 (in FIG. 9).

As described in FIG. 11, comparator circuit 540 comprises an operational amplifier (op amp) 560, and first and second resistors 542,546. Op amp 560 has a non-inverting input 562, an inverting input 564, and an output 566. Inverting input 564 is coupled to output 514 of signal detector circuit 510. Output 566 is coupled to logic circuit 600. First resistor 542 is coupled between a reference voltage, $V_{REF}$, and non-inverting input 562. Second resistor 546 is coupled between non-inverting input 562 and output 566 of op amp 560.

During operation, comparator circuit 540 provides a logic signal in accordance with the power line carrier control signal. Like comparator circuit 440 (in FIG. 9), comparator circuit 540 provides a useful degree of immunity to common-mode noise in the signal provided at the output of the signal detector circuit.

As described in FIG. 11, phase detector circuit 570 comprises an operational amplifier (op amp) 580, and first, second, third, and fourth resistors 572,574,576,578. Op amp 580 has a non-inverting input 582, an inverting input 584, and an output 586. Non-inverting input 582 is coupled to a reference voltage, $V_{REF}$. Output 586 is coupled to logic circuit 600. First resistor 572 is coupled between second input terminal 504 and inverting input 584. Second resistor 574 is coupled between inverting input 584 and circuit ground 90. Third resistor 576 is coupled between non-inverting input 582 and circuit ground 90. Fourth resistor 578 is coupled between non-inverting input 582 and output 586. The structure and operation of phase detector circuit 570 are the same as that which was previously described with reference to phase detector circuit 330 (in FIG. 7).

Referring again to FIG. 11, logic circuit 600 comprises an inverting gate 610, a first AND gate 620, and a second AND gate 630. Inverting gate 610 has an input 612 and an output 614. Input 612 of inverting gate 610 is coupled to output 586 of op amp 580 within phase detector circuit 570. First AND gate 620 has a first input 622, a second input 624, and an output 626. First input 622 of first AND gate 620 is coupled to input 612 of inverting gate 610. Second input 624 of first AND gate 620 is coupled to output 566 of op amp 560 within comparator circuit 540. Output 626 of first AND gate 620 is coupled to second output terminal 508 of PLC circuit 500. Second AND gate 630 has a first input 632, a second input 634, and an output 636. First input 632 of second AND gate 630 is coupled to output 614 of inverting gate 610. Second input 634 of second AND gate 630 is coupled to second input 624 of first AND gate 620. Output 636 of second AND gate 630 is coupled to first output terminal 506 of PLC circuit 500. During operation, logic circuit 600 provides logic signals at first and second output terminals 506,508 of PLC circuit 500 in dependence on the power line carrier control signal, $V_{CONTROL}$, and the phase of the voltage, $V_{AC}$, between the hot and neutral wires of the AC power source; that is, the logic signals provided by PLC circuit 500 are correlated with the positive and negative half-cycles of $V_{AC}$. In the simplest application, this arrangement provides a capability wherein two distinct commands may be delivered to inverter 160. For ballast 70, the response time provided by signal detector circuit 510 should be designed to be less than half of the period corresponding to an AC source frequency of 50 hertz or 60 hertz. Additionally, any low frequency common mode noise internal to ballast 70 should be minimized by a proper layout of the printed circuit board (i.e., on which the electrical components of ballast 70 are preferably mounted/connected) and by appropriate use of surface-mount components, according to established practices known to those skilled in the art.

Figure 12:
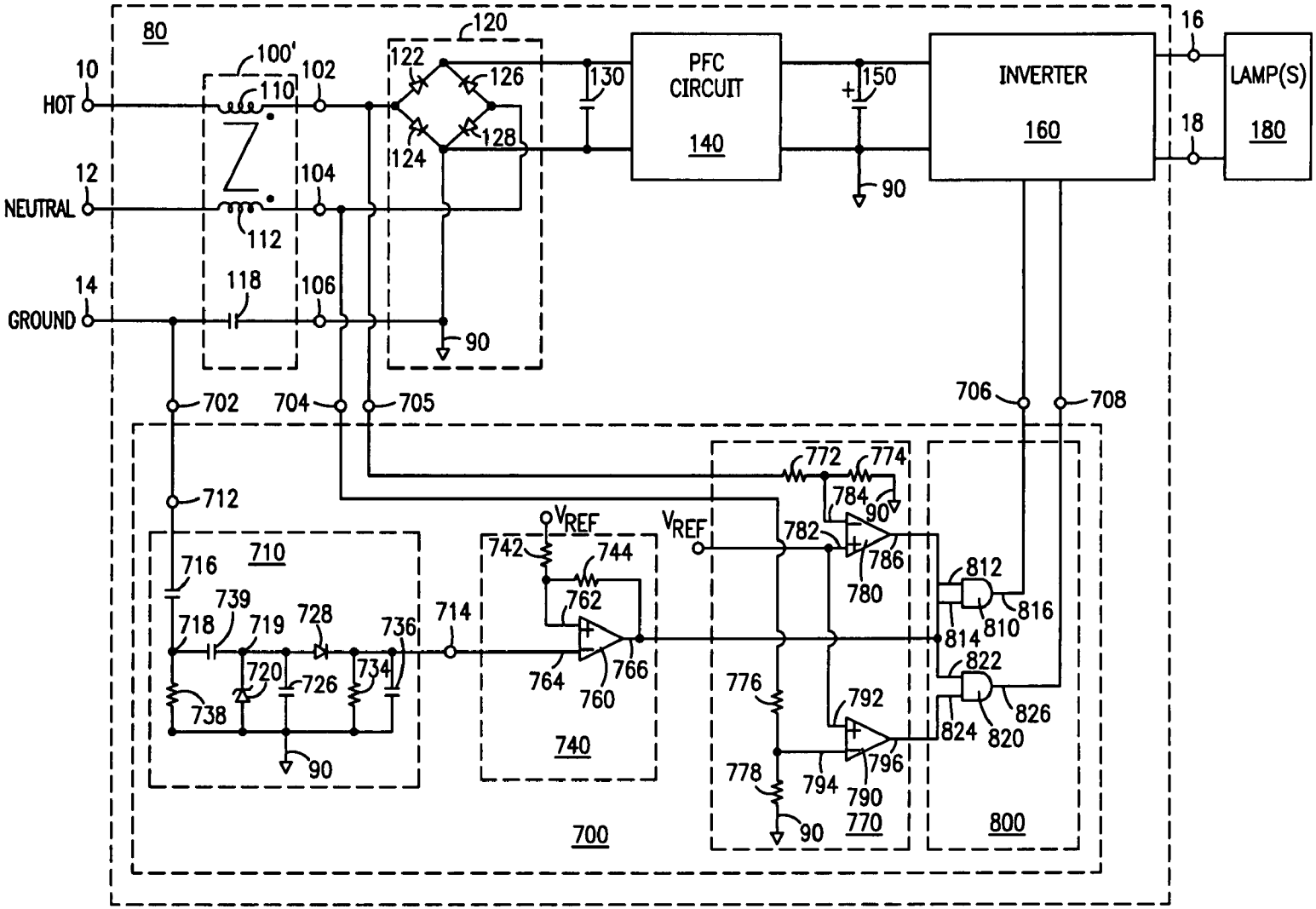
FIG. 12 is a partial block-diagram schematic of an electronic ballast with a power line communication circuit, in accordance with a fourth specific preferred embodiment of the present invention.

FIG. 12 describes a ballast 80 that is configured in accordance with a fourth preferred embodiment of the present invention. Ballast 80 includes a PLC circuit 700 that accommodates multi-bit power line communication. Multi-bit power line communication capability enables more sophisticated control options, such as controlling the inverter to provide for multiple light output levels (as opposed to only two or three discrete light levels, as in load shedding schemes, such as that which is provided by the arrangements described in FIGS. 9 and 11).

EMI filter 100' and full-wave rectifier 120 are preferably realized with the same structures previously described with reference to FIG. 9. However, the structure and operation of PLC circuit 700 is somewhat different from the circuits that have been previously described above.

PLC circuit 700 comprises first, second, and third input terminals 702,704,705, first and second output terminals 706, 708, a signal detector circuit 710, a comparator circuit 740, a phase detector circuit 770, and a logic circuit 800. First input terminal 702 is coupled to the ground wire of the AC power source via third input connection 14 of EMI filter 100'. Second input terminal 704 is coupled to the second output connection 104 of EMI filter 100'. Third input terminal 705 is coupled to the first output connection 102 of EMI filter 100'. First and second output connections 706,708 are coupled to inverter 160.

Referring to FIG. 12, signal detector circuit 710 comprises an input 812, an output 714, a first capacitor 716, a first resistor 738, a second capacitor 739, a zener diode 720, a third capacitor 726, a diode 728, a second resistor 734, and a fourth capacitor 736. Input 712 is coupled to first input terminal 702 of PLC circuit 700. Output 714 is coupled to comparator circuit 740. First capacitor 716 is coupled between input 712 and a first node 718. First resistor 738 is coupled between first node 718 and circuit ground 90. Second capacitor 739 is coupled between first node 718 and a second node 719. Zener diode 720 and third capacitor 726 are each coupled between second node 719 and circuit ground 90. Diode 728 is coupled between second node 719 and output 714. Second resistor 734 and fourth capacitor 736 are each coupled between output 714 and circuit ground 90.

During operation, signal detector circuit 710 provides a predetermined output voltage at output 714 when a power line carrier control signal is applied between the neutral and ground wires of the AC power source. Within signal detector circuit 710, first capacitor 716 and first resistor 738 function as a high pass filter that suppresses any low frequency (e.g., 60 hertz) noise that is present in the voltage at input 712.

Referring again to FIG. 12, comparator circuit 740 comprises an operational amplifier (op amp) 760, and first and second resistors 742,744. Op amp 760 has a non-inverting input 762, an inverting input 764, and an output 766. Inverting input 764 is coupled to output 714 of signal detector circuit 710. Output 766 is coupled to logic circuit 800. First resistor 742 is coupled between a reference voltage, $V_{REF}$, and non-inverting input 762. Second resistor 746 is coupled between non-inverting input 762 and output 766 of op amp 760. The structure and operation of comparator circuit 740 is the same as that which was previously described with reference to comparator circuit 540 (in FIG. 11).

As described in FIG. 12, phase detector circuit 770 comprises a first operational amplifier (op amp) 780, a second op amp 790, and first, second, third, and fourth resistors 772,774, 776,778. First op amp 780 has a non-inverting input 782, an inverting input 784, and an output 786. Non-inverting input 782 is coupled to a reference voltage, $V_{REF}$. Output 786 of first op amp 780 is coupled to logic circuit 800. Second op amp 790 has a non-inverting input 792, an inverting input 794, and an output 796. Non-inverting input 792 is coupled to the reference voltage, $V_{REF}$. Output 796 of second op amp 790 is coupled to logic circuit 800. First resistor 772 is coupled between third input terminal 705 of PLC circuit 700 and inverting input 784 of first op amp 780. Second resistor 774 is coupled between inverting input 784 of first op amp 780 and circuit ground 90. Third resistor 776 is coupled between second input terminal 704 of PLC circuit 700 and inverting input 794 of second op amp 780. Fourth resistor 778 is coupled between inverting input 794 of second op amp 790 and circuit ground 90.

During operation, phase detector circuit 770 generates output signals (which are then provided to logic circuit 800) in dependence on the phase of the voltage, $V_{AC}$, that is present between the hot and neutral wires of the AC power source. More particularly, phase detector circuit 770 operates to generate sampling time intervals corresponding to the positive and negative half cycles of $V_{AC}$, including "dead time" intervals (during which the outputs of both op amps 780,790 are at a logic "0" level) around the times that $V_{AC}$ passes through zero (commonly referred to as the "zero crossings" of $V_{AC}$). Internal common-mode noise problems (attributable to operation of PFC circuit 140) are especially problematic around the zero crossings of $V_{AC}$. Thus, by generating these sampling time intervals, phase detector circuit 770 (operating in conjunction with logic circuit 800) helps to overcome internal noise problems (which are especially pronounced around the zero crossings of $V_{AC}$) that otherwise interfere with effective multi-bit data transmission. By generating "dead time" intervals during the zero crossings of $V_{AC}$, phase detector circuit 770 ensures that, even if signal detector circuit 710 responds to noise, no resulting "false" signals will be allowed to pass through to output terminals 706,708.

Referring again to FIG. 12, logic circuit 800 comprises first and second AND gates 810,820. First AND gate 810 has a first input 812, a second input 814, and an output 816. First input 812 is coupled to output 786 of first op amp 780 within phase detector circuit 770. Second input 814 is coupled to output 766 of op amp 760 within comparator circuit 740. Output 816 is coupled to first output terminal 706 of PLC circuit 800. Second AND gate 820 has a first input 822, a second input 824, and an output 826. First input 822 is coupled to output 766 of op amp 760 within comparator circuit 740. Second input 824 is coupled to output 796 of second op amp 790 within phase detector circuit 770. Output 826 is coupled to second output terminal 708 of PLC circuit 800. During operation, logic circuit 800 provides logic signals (at first and second output terminals 706,708) in dependence on the power line carrier control signal and the phase of the voltage, $V_{AC}$, provided between the hot and neutral wires of the AC power source.

Advantageously, PLC circuit 700 is capable of quickly responding to a power line carrier control signal and of receiving data at a rate that is on the order of about 120 bits per second.

Preferred nominal values for certain components in ballast 80 are as follows. Within EMI filter 100', capacitor 118 has a capacitance of 3300 picofarads. Within signal detector circuit 710, capacitors 716 and 739 each have a capacitance of 1 nanofarad, resistor 738 has a resistance of 100 kilohms, resistor 734 has a resistance of 51 kilohms, and capacitor 736 has a capacitance of 10 nanofarads.

Although the present invention has been described with reference to certain preferred embodiments, numerous modifications and variations can be made by those skilled in the art without departing from the novel spirit and scope of this invention.

What is claimed is:

1. An arrangement, comprising:

an alternating current (AC) power source having a hot wire, a neutral wire, and a ground wire, wherein the AC power source includes a control station for injecting a power line carrier control signal between the neutral wire and the ground wire, the power line carrier control signal having a fundamental frequency;

a load; and a circuit for supplying power to the load, comprising:

an electromagnetic interference (EMI) filter coupled to the hot, neutral, and ground wires of the AC power source, the EMI filter having an effective common-mode resonant frequency, wherein the fundamental frequency of the power line carrier control signal is approximately equal to one of: (i) the effective common-mode resonant frequency of the EMI filter; and (ii) a harmonic of the effective common-mode resonant frequency of the EMI filter;

power processing circuitry coupled between the EMI filter and the load; and a power line communication (PLC) circuit coupled to the EMI filter and the power processing circuitry, wherein the PLC circuit is operable to detect the power line carrier control signal and to direct the power processing circuitry to control the power provided to the load in dependence on the detected power line carrier control signal.

2. The arrangement of claim 1, wherein the PLC circuit is further operable to direct the power processing circuitry to control the power to the load in dependence on both:

(i) the detected power line carrier control signal; and (ii) timing of the detected power line carrier control signal with respect to a phase of a voltage provided by the AC power source between the hot wire and the neutral wire.

3. The arrangement of claim 1, wherein the the circuit for supplying power to the load is an electronic ballast;

the power processing circuitry includes an inverter; and the load consists of at least one gas discharge lamp.

4. A method for providing power line communication from an alternating current (AC) power source to a circuit for supplying power to a load, the AC power source having a hot wire, a neutral wire, and a ground wire, the method comprising the steps of:

providing, within the AC power source, a control station for generating a power line carrier control signal having a fundamental frequency, wherein the control station is coupled between the neutral and ground wires;

providing, within the circuit for supplying power to the load:

an electromagnetic interference (EMI) filter coupled to the AC power source, wherein the EMI filter has an effective common-mode resonant frequency;

power processing circuitry coupled between the EMI filter and the load; and a power line communication (PLC) circuit coupled to the EMI filter and the power processing circuitry;

setting, within the control station, the fundamental frequency of the power line carrier control signal to be approximately equal to one of: (i) the effective common-mode resonant frequency of the EMI filter; and (ii) a harmonic of the effective common-mode resonant frequency of the EMI filter;

injecting, via the control station, a power line carrier control signal between the neutral wire and the ground wire of the AC power source;

detecting the power line carrier control signal by monitoring, via the PLC circuit, a current flowing from the ground wire to a circuit ground; and directing, via the PLC circuit, the power processing circuitry to control the power supplied to the load in dependence on the detected power line carrier control signal.

5. The method of claim 4, wherein the step of directing is dependent on both:

(i) the detected power line carrier control signal; and (ii) timing of the detected power line carrier control signal with respect to a phase of a voltage provided by the AC power source between the hot wire and the neutral wire.

6. The method of claim 4, wherein:

the circuit for supplying power to the load is an electronic ballast; and the load consists of at least one gas discharge lamp.

7. A ballast for powering at least one gas discharge lamp, the ballast comprising:

an electromagnetic interference (EMI) filter, comprising:

a first input connection adapted for coupling to a hot wire of an alternating current (AC) power source;

a second input connection adapted for coupling to a neutral wire of the AC power source;

a third input connection adapted for coupling to a ground wire of the AC power source; and first and second output connections;

a full-wave rectifier coupled to the first and second output connections of the EMI filter;

a power factor correction (PFC) circuit coupled to the full-wave rectifier;

an inverter coupled to the PFC circuit, the inverter comprising first and second output connections adapted for coupling to the at least one gas discharge lamp;

a power line communication (PLC) circuit, comprising a first input terminal coupled to the ground wire of the AC power source, and a first output terminal coupled to the inverter, wherein:

the PLC circuit is operable to control operation of the inverter in accordance with a power line carrier control signal that is applied by the AC power source between the neutral and ground wires, wherein the power line carrier control signal has a fundamental frequency; and the PLC circuit is further operable to utilize an effective common-mode resonant frequency of the EMI filter to detect the power line carrier control signal, wherein the fundamental frequency of the power line carrier control signal is approximately equal to one of: (i) the effective common-mode resonant frequency of the EMI filter; and (ii) a harmonic of the effective common-mode resonant frequency of the EMI filter.

8. The ballast of claim 7, wherein the effective common-mode resonant frequency of the EMI filter is on the order of about 20,000 hertz.

9. The ballast of claim 8, wherein the fundamental frequency of the power line carrier control signal is on order of about one of:

(i) 20,000 hertz; and (ii) an integer multiple of 20,000 hertz.

10. The ballast of claim 7, wherein the ballast is further operable, in response to the power line carrier control signal corresponding to a load shed command, to reduce an illumination level of the at least one gas discharge lamp.

11. The ballast of claim 7, wherein:

the EMI filter further comprises:

a first inductor coupled between the first input connection and the first output connection of the EMI filter;

a second inductor coupled between the second input connection and the second output connection of the EMI filter, wherein the second inductor is magnetically coupled to the first inductor;

a first capacitor coupled between the first output connection and the third input connection of the EMI filter; and a second capacitor coupled between the third input connection and the second output connection; and the PLC circuit further comprises:

a second input terminal coupled to the second output connection of the EMI filter;

a second output terminal coupled to the inverter;

a signal detector circuit having an input and an output, wherein the input is coupled to the first input terminal of the PLC circuit, the signal detector circuit being operable to provide a predetermined voltage at the output in response to the power line carrier control signal;

a phase detector circuit coupled to the second input terminal and operable to provide an output voltage in dependence on a phase of the voltage between the hot and neutral wires of the AC power source; and a logic circuit coupled to the output of the signal detector circuit, the phase detector circuit, and the first and second output terminals of the PLC circuit, the logic circuit being operable to provide a logic signal at the second output terminal of the PLC circuit in dependence on the power line carrier control signal and the phase of the voltage between the hot and neutral wires of the AC power source.

12. The ballast of claim 11, wherein the signal detector circuit comprises:

a frequency detector having a first input, a second input, and an output, wherein the second input is coupled to circuit ground;

a capacitor coupled between the input of the signal detector circuit and the first input of the frequency detector; and a resistor coupled between the first and second inputs of the frequency detector.

13. The ballast of claim 11, wherein the phase detector circuit comprises:

an operational amplifier (op amp) having a non-inverting input, an inverting input, and an output;

a first resistor coupled between the second input terminal of the PLC circuit and the inverting input of the op amp;

a second resistor coupled between the inverting input of the op amp and circuit ground;

a third resistor coupled between a reference voltage and the non-inverting input of the op amp;

a fourth resistor coupled between the non-inverting input of the op amp and circuit ground; and a fifth resistor coupled between the non-inverting input and the output of the op amp.

14. The ballast of claim 11, wherein the logic circuit comprises an AND gate having a first input, a second input, and an output, wherein:

the first input of the AND gate is coupled to the phase detector circuit;

the second input of the AND gate is coupled to the output of the signal detector circuit; and the output of the AND gate is coupled to the second output terminal of the PLC circuit.

15. The ballast of claim 7, wherein:

the EMI filter further comprises:

a first inductor coupled between the first input connection and the first output connection of the EMI filter;

a second inductor coupled between the second input connection and the second output connection of the EMI filter;

a third output connection coupled to circuit ground; and a capacitor coupled between the third input connection and the third output connection of the EMI filter; and the PLC circuit further comprises:

a signal detector circuit having an input and an output, wherein the input is coupled to the first input terminal, the signal detector circuit being operable to provide a predetermined voltage at the output in response to the power line carrier control signal; and a comparator circuit coupled between the output of the signal detector circuit and the first output terminal of the PLC circuit, the comparator circuit being operable to provide a logic signal at the first output terminal of the PLC circuit in accordance with the power line carrier control signal.

16. The ballast of claim 15, wherein the signal detector circuit further comprises:

a first capacitor coupled between the input of the signal detector circuit and a first node;

a zener diode coupled between the first node and circuit ground;

a second capacitor coupled between the first node and circuit ground;

a diode coupled between the first node and the output of the signal detector circuit;

a resistor coupled between the output of the signal detector circuit and circuit ground; and a third capacitor coupled between the output of the signal detector circuit and circuit ground.

17. The ballast of claim 15, wherein the comparator circuit comprises:

an operational amplifier (op amp) having a non-inverting input, an inverting input, and an output, wherein the output of the op amp is coupled to the first output connection of the PLC circuit;

a first resistor coupled between a reference voltage and the non-inverting input of the op amp;

a second resistor coupled between the non-inverting input of the op amp and circuit ground;

a third resistor coupled between the non-inverting input and the output of the op amp;

a fourth resistor coupled between the output of the signal detector circuit and the inverting input of the op amp; and a capacitor coupled between the inverting input of the op amp and circuit ground.

18. The ballast of claim 7, wherein:

the EMI filter further comprises:

a first inductor coupled between the first input connection and the first output connection of the EMI filter;

a second inductor coupled between the second input connection and the second output connection of the EMI filter;

a third output connection coupled to circuit ground; and a capacitor coupled between the third input connection and the third output connection of the EMI filter; and the PLC circuit further comprises:

a second input terminal coupled to the second output connection of the EMI filter;

a second output terminal coupled to the inverter;

a signal detector circuit having an input and an output, wherein the input is coupled to the first input terminal of the PLC circuit, the signal detector circuit being operable to provide a predetermined voltage at the output in response to the power line carrier control signal;

a comparator circuit coupled to the output of the signal detector circuit, the comparator circuit being operable to provide a logic signal at the first output terminal of the PLC circuit in dependence on the power line carrier control signal;

a phase detector circuit coupled to the second input terminal of the PLC circuit, the phase detector circuit being operable to provide an output voltage in dependence on a phase of the voltage between the hot and neutral wires of the AC power source; and a logic circuit coupled to the comparator circuit, the phase detector circuit, and the first and second output terminals of the PLC circuit, the logic circuit being operable to provide logic signals at the first and second output terminals of the PLC circuit in dependence on the power line carrier control signal and the phase of the voltage between the hot and neutral wires of the AC power source.

19. The ballast of claim 18, wherein the signal detector circuit further comprises:

a first capacitor coupled between the input of the signal detector circuit and a first node;

a zener diode coupled between the first node and circuit ground;

a second capacitor coupled between the first node and circuit ground;

a diode coupled between the first node and the output of the signal detector circuit;

a resistor coupled between the output of the signal detector circuit and circuit ground; and a third capacitor coupled between the output of the signal detector circuit and circuit ground.

20. The ballast of claim 18, wherein the comparator circuit comprises:

an operational amplifier (op amp) having a non-inverting input, an inverting input, and an output, wherein the inverting input of the op amp is coupled to the output of the signal detector circuit, and the output of the op amp is coupled to the logic circuit;

a first resistor coupled between a reference voltage and the non-inverting input of the op amp; and a second resistor coupled between the non-inverting input and the output of the op amp.

21. The ballast of claim 18, wherein the phase detector circuit comprises:

an operational amplifier (op amp) having a non-inverting input, an inverting input, and an output, wherein the non-inverting input of the op amp is coupled to a reference voltage and the output of the op amp is coupled to the logic circuit;

a first resistor coupled between the second input of the PLC circuit and inverting input of the op amp;

a second resistor coupled between the inverting input of the op amp and circuit ground;

a third resistor coupled between the non-inverting input of the op amp and circuit ground; and a fourth resistor coupled between the non-inverting input and the output of the op amp.

22. The ballast of claim 18, wherein the logic circuit comprises:

an inverting gate having an input and an output, wherein the input of the inverting gate is coupled to the phase detector circuit;

a first AND gate having a first input, a second input, and an output, wherein the first input of the first AND gate is coupled to the input of the inverting gate, the second input of the first AND gate is coupled to the comparator circuit, and the output of the first AND gate is coupled to the second output terminal of the PLC circuit; and a second AND gate having a first input, a second input, and an output, wherein the first input of the second AND gate is coupled to the output of the inverting gate, the second input of the second AND gate is coupled to the second input of the first AND gate, and the output of the second AND gate is coupled to the first output terminal of the PLC circuit.

23. The ballast of claim 7, wherein:

the EMI filter further comprises:

a first inductor coupled between the first input connection and the first output connection of the EMI filter;

a second inductor coupled between the second input connection and the second output connection of the EMI filter;

a third output connection coupled to circuit ground; and a capacitor coupled between the third input connection and the third output connection of the EMI filter;

the PLC circuit further comprises:

a second input terminal coupled to the second output connection of the EMI filter;

a third input terminal coupled to the first output connection of the EMI filter;

a second output terminal coupled to the inverter;

a signal detector circuit having an input and an output, wherein the input is coupled to the first input terminal of the PLC circuit, the signal detector circuit being operable to provide a predetermined voltage at the output in response to the power line carrier control signal;

a comparator circuit coupled to the output of the signal detector circuit, the comparator circuit being operable to provide a logic signal in dependence on the power line carrier control signal;

a phase detector circuit coupled to the second and third input terminals of the PLC circuit, the phase detector circuit being operable to provide output signals in dependence on a phase of the voltage between the hot and neutral wires of the AC power source; and a logic circuit coupled to the comparator circuit, the phase detector circuit, and the first and second output terminals of the PLC circuit, the logic circuit being operable to provide logic signals at the first and second output terminals of the PLC circuit in dependence on the power line carrier control signal and the phase of the voltage between the hot and neutral wires of the AC power source.

24. The ballast of claim 23, wherein the signal detector circuit further comprises:

a first capacitor coupled between the input of the signal detector circuit and a first node;

a first resistor coupled between the first node and circuit ground;

a second capacitor coupled between the first node and a second node;

a zener diode coupled between the second node and circuit ground;

a third capacitor coupled between the second node and circuit ground;

a diode coupled between the second node and the output of the signal detector circuit;

a second resistor coupled between the output of the signal detector circuit and circuit ground; and a fourth capacitor coupled between the output of the signal detector circuit and circuit ground.

25. The ballast of claim 23, wherein the comparator circuit comprises:

an operational amplifier (op amp) having a non-inverting input, an inverting input, and an output, wherein the inverting input of the op amp is coupled to the output of the signal detector circuit, and the output of the op amp is coupled to the logic circuit;

a first resistor coupled between a reference voltage and the non-inverting input of the op amp; and a second resistor coupled between the non-inverting input and the output of the op amp.

26. The ballast of claim 23, wherein the phase detector circuit comprises:

a first operational amplifier (op amp) having a non-inverting input, an inverting input, and an output, wherein the non-inverting input of the first op amp is coupled to a reference voltage, and the output of the first op amp is coupled to the logic circuit;

a second op amp having a non-inverting input, an inverting input, and an output, wherein the non-inverting input of the second op amp is coupled to the reference voltage, and the output of the second op amp is coupled to the logic circuit;

a first resistor coupled between the third input terminal of the PLC circuit and the inverting input of the first op amp;

a second resistor coupled between the inverting input of the first op amp and circuit ground;

a third resistor coupled between the second input terminal of the PLC circuit and the inverting input of the second op amp; and a fourth resistor coupled between the inverting input of the second op amp and circuit ground.

27. The ballast of claim 23, wherein the logic circuit comprises:

a first AND gate having a first input, a second input, and an output, wherein the first input of the first AND gate is coupled to the phase detector circuit, the second input of the first AND gate is coupled to the comparator circuit, and the output of the first AND gate is coupled to the first output terminal of the PLC circuit; and a second AND gate having a first input, a second input, and an output, wherein the first input of the second AND gate is coupled to the second input of the first AND gate, the second input of the second AND gate is coupled to the phase detector circuit, and the output of the second AND gate is coupled to the second output terminal of the PLC circuit.

* * * * *